US012808587B2

(12) United States Patent
Clunet et al.

(10) Patent No.: US 12,808,587 B2
(45) Date of Patent: Nov. 24, 2026

(54) ECONOMIZER FOR A CHILLER

(71) Applicant: Tyco Fire & Security GmbH, Neuhausen am Rheinfall (CH)

(72) Inventors: Francois Charles Andre Clunet, La Chapelle-sur-Erdre (FR); Damien Jean Daniel Arnou, La Séguinière (FR); Jeb William Schreiber, Stewartstown, PA (US); Paul Eric Le Sausse, Nantes (FR)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 224 days.

(21) Appl. No.: 18/705,429

(22) PCT Filed: Oct. 26, 2022

(86) PCT No.: PCT/US2022/047906

§ 371 (c)(1),
(2) Date: Apr. 26, 2024

(87) PCT Pub. No.: WO2023/076403

PCT Pub. Date: May 4, 2023

(65) Prior Publication Data

US 2025/0230960 A1 Jul. 17, 2025

Related U.S. Application Data

(60) Provisional application No. 63/272,039, filed on Oct. 26, 2021.

(51) Int. Cl.
*F25B 43/00* (2006.01)
*F25B 41/39* (2021.01)

(52) U.S. Cl.
CPC ..... *F25B 43/00* (2013.01); *F25B 41/39* (2021.01); *F25B 2400/13* (2013.01)

(58) Field of Classification Search
CPC ..... F25B 2400/13; F25B 43/00; F25B 49/02; F25B 1/10; F25B 2400/075;
(Continued)

(56) References Cited

U.S. PATENT DOCUMENTS 1,505,743 A 8/1924 Stebbins
2,511,967 A * 6/1950 Campbell ..... B01D 45/08 210/512.1

(Continued)

FOREIGN PATENT DOCUMENTS

CH 703290 A1 12/2011
CN 209512341 * 10/2019

(Continued)

OTHER PUBLICATIONS

Machine Translation, KR 101092692 to Kim, Dec. 5, 2011.*

(Continued)

*Primary Examiner* — Jonathan Bradford
(74) *Attorney, Agent, or Firm* — Fletcher Yoder, PC

(57) ABSTRACT

An economizer for a heating, ventilation, air conditioning, and refrigeration (HVAC&R) system includes a housing defining a first chamber and a second chamber, an inlet conduit coupled to the housing and configured to direct a flow of working fluid into the first chamber, and a perforated sheet disposed within the first chamber, where the perforated sheet is curved and is configured to direct the flow of working fluid received by the first chamber in a circular direction.

20 Claims, 13 Drawing Sheets

(58) Field of Classification Search
CPC ..... F25B 2400/23; F25B 2600/2513; F25B 2700/04; F25B 41/39
See application file for complete search history.

(56) References Cited

U.S. PATENT DOCUMENTS

| | | | | |
|---|---|---|---|---|
| 2007/0151269 | A1* | 7/2007 | Crane | F25B 41/24 62/216 |
| 2008/0184721 | A1 | 8/2008 | Crane et al. | |
| 2017/0336106 | A1* | 11/2017 | Morgan | F25B 39/00 |
| 2018/0363962 | A1 | 12/2018 | Ding et al. | |

FOREIGN PATENT DOCUMENTS

| | | | |
|---|---|---|---|
| CN | 209512341 | U | 10/2019 |
| CN | 113063234 | A | 7/2021 |
| KR | 101092692 | * | 12/2011 |
| KR | 101092692 | B1 | 12/2011 |
| TW | 200921030 | A | 5/2009 |
| TW | 201727171 | A | 8/2017 |

OTHER PUBLICATIONS

Machine translation. CN 209512341, to Hongyu, Oct. 18, 2019.*
International Search Report and Written Opinion for PCT Application No. PCT/US2022/047906, mailed Feb. 24, 2023, 11 pages.

* cited by examiner

ECONOMIZER FOR A CHILLER

CROSS-REFERENCE TO RELATED APPLICATION

This application claims priority from and the benefit of U.S. Provisional Application No. 63/272,039, entitled "AN ECONOMIZER FOR A CHILLER," filed Oct. 26, 2021, which is herein incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Chiller systems, or vapor compression systems, utilize a working fluid (e.g., a refrigerant) that changes phases between vapor, liquid, and combinations thereof in response to exposure to different temperatures and pressures within components of the chiller system. The chiller system may place the working fluid in a heat exchange relationship with a cooling fluid (e.g., water) and may deliver the cooling fluid to conditioning equipment and/or a conditioned environment serviced by the chiller system. In some embodiments, the chiller system may include one or more compressors configured to pressurize the working fluid and direct the pressurized working fluid through the chiller system, such as to a heat exchanger of the chiller system. For example, the compressor may compress a working fluid gas and then deliver the compressed gas (e.g., vapor) to a condenser. The compressor places the compressed gas in a heat exchange relationship with a fluid (e.g., a conditioning fluid, such as air or water), and the working fluid gas undergoes a phase change to a working fluid liquid. The liquid working fluid from the condenser is directed through a corresponding expansion device(s) to an evaporator of the chiller system. The evaporator places the liquid working fluid in a heat exchange relationship with another fluid (e.g., the cooling fluid, such as air, water, or other process fluid), and the liquid working fluid undergoes a phase change to a working fluid vapor. The working fluid vapor may then be directed back to the compressor.

In some applications, the chiller system may include an economizer to improve performance and/or efficiency of the chiller system. The economizer may receive working fluid from the condenser may reduce a pressure of the working fluid to further cool the working fluid and separate the working fluid into liquid phase working fluid and vapor phase working fluid. The economizer may direct the liquid phase working fluid to the evaporator configured to place the working fluid in the heat exchange relationship with the cooling fluid. The economizer may direct the vapor phase working fluid to the compressor for pressurization. Unfortunately, existing chiller systems that include economizers may operate inefficiently and/or may occupy a large physical footprint.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, an economizer for a heating, ventilation, air conditioning, and refrigeration (HVAC&R) system includes a housing defining a first chamber and a second chamber, an inlet conduit coupled to the housing and configured to direct a flow of working fluid into the first chamber, and a perforated sheet disposed within the first chamber, where the perforated sheet is curved and is configured to direct the flow of working fluid received by the first chamber in a circular direction.

In another embodiment, an economizer for a heating, ventilation, air conditioning, and refrigeration (HVAC&R) system includes a housing defining a first chamber and a second chamber, an inlet conduit coupled to the housing and configured to direct a flow of working fluid into the first chamber, a perforated sheet disposed within the first chamber, where the perforated sheet is configured to direct the flow of working fluid received by the first chamber in a circular direction, and the perforated sheet is configured to separate the flow of working fluid into vapor working fluid and liquid working fluid, and a liquid outlet conduit extending from the first chamber to the second chamber, where the liquid outlet conduit is configured to direct the liquid working fluid from the first chamber toward the second chamber.

In a further embodiments, an economizer for a heating, ventilation, air conditioning, and refrigeration (HVAC&R) system includes a housing defining a first chamber and a second chamber, where the first chamber is configured to receive a flow of working fluid from a vapor compression circuit, a separation plate disposed within the housing to separate the first chamber from the second chamber within the housing, and a perforated sheet disposed within the housing. The perforated sheet extends within the first chamber, the perforated sheet divides the first chamber into a first section and a second section, the perforated sheet is configured to direct the flow of working fluid received by the first chamber in a circular direction, and the perforated sheet is configured to separate the flow of working fluid into vapor working fluid and liquid working fluid. The economizer further includes a liquid outlet conduit extending from the first chamber to the second chamber, where the liquid outlet conduit is configured to direct the liquid working fluid from the first chamber toward the second chamber.

DRAWINGS

Various aspects of this disclosure may be better understood upon reading the following detailed description and upon reference to the drawings in which.

DETAILED DESCRIPTION

Figure 1:
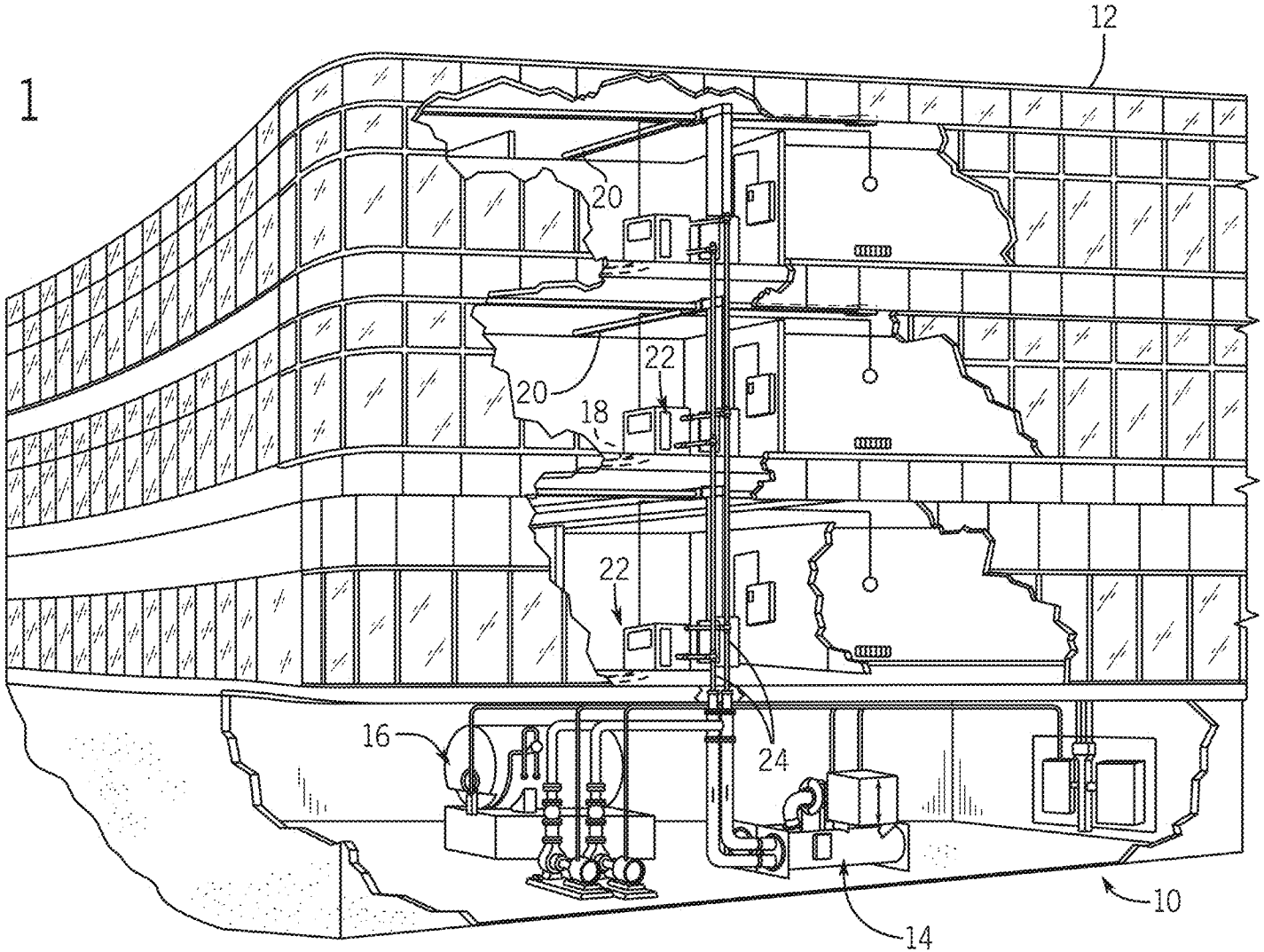
FIG. 1 is a perspective view of an embodiment of a building that may utilize a heating, ventilating, air conditioning, and/or refrigeration (HVAC&R) system in a commercial setting, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of the present disclosure relate to a heating, ventilation, air conditioning, and/or refrigeration (HVAC&R) system having a vapor compression system (e.g., vapor compression circuit). The vapor compression system may include a compressor (e.g., a primary compressor) configured to pressurize a working fluid within the vapor compression system and direct the working fluid to a condenser, which may cool and condense the working fluid. The condensed working fluid may be directed toward an expansion device, which may reduce a pressure of the working fluid, further cooling the working fluid. From the expansion device, the cooled working fluid may be directed to an evaporator, where the working fluid may be placed in a heat exchange relationship with a cooling fluid to cool the cooling fluid. The compressor may then receive the working fluid from the evaporator for pressurization to restart the vapor compression cycle.

In some embodiments, the vapor compression system may include an economizer configured to receive the working fluid from the condenser. The economizer may be configured to reduce a pressure of the working fluid and separate the working fluid into liquid working fluid and vapor working fluid. The economizer may direct the liquid working fluid to the evaporator to enable the evaporator to place the liquid working fluid in a heat exchange relationship with the cooling fluid. The vapor working fluid may be directed from the economizer to a compressor system and then to the condenser. In some applications, the economizer (e.g., economizer system) may include multiple chambers configured to receive working fluid and separate the working fluid into liquid working fluid and vapor working fluid. The liquid working fluid from each chamber may be directed to a subsequent chamber of the economizer and/or may be directed to the evaporator, while the vapor working fluid from each chamber may be directed to the compressor system, such as one or more auxiliary compressors of the vapor compression system.

In accordance with present techniques, the economizer may be configured to enable and/or induce a swirling or rotational flow of the working fluid to cause separation of the working fluid into the liquid working fluid and the vapor working fluid. As will be appreciated, the swirling flow of the working fluid may cause centrifugal acceleration forces to act on the working fluid, thereby promoting separation of the working fluid into the vapor working fluid and the liquid working fluid. Additionally, the swirling flow of working fluid enabled by the disclosed embodiments may enable more a compact configuration (e.g., reduced physical footprint) of the economizer, as compared to existing economizers. In this way, costs associated with manufacture and operation of the HVAC&R system may be reduced. Furthermore, in accordance with present techniques, the economizer may include multiple chambers configured to induce a swirling or rotational flow of the working fluid to separate the working fluid into the liquid working fluid and the vapor working fluid, which may enable improved operation of the HVAC&R system (e.g., improved efficiency) across a wide range of operating capacities.

It should be understood that, as used herein, mathematical terms, such as "tangential," are intended to encompass features of surfaces or elements as understood to one of ordinary skill in the relevant art and are not limited to their respective definitions as might be understood in the mathematical arts. For example, "tangential" is intended to encompass orientations or directions that extend adjacent or proximate to a tangent line of a circle or curve (e.g., as opposed to extending along a diameter of a circle) or along an edge of a circle or curve.

Turning now to the drawings, FIG. 1 is a perspective view of an embodiment of an environment for a heating, ventilation, air conditioning, and refrigeration (HVAC&R) system 10 in a building 12 for a typical commercial setting. The HVAC&R system 10 may include a vapor compression system 14 (e.g., a chiller, chiller system) that supplies a chilled liquid, which may be used to cool the building 12. The HVAC&R system 10 may also include a boiler 16 to supply warm liquid to heat the building 12 and an air distribution system which circulates air through the building 12. The air distribution system can also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC&R system 10. The HVAC&R system 10 is shown with a separate air handler on each floor of building 12, but in other embodiments, the HVAC&R system 10 may include air handlers 22 and/or other components that may be shared between or among floors.

Figure 2:
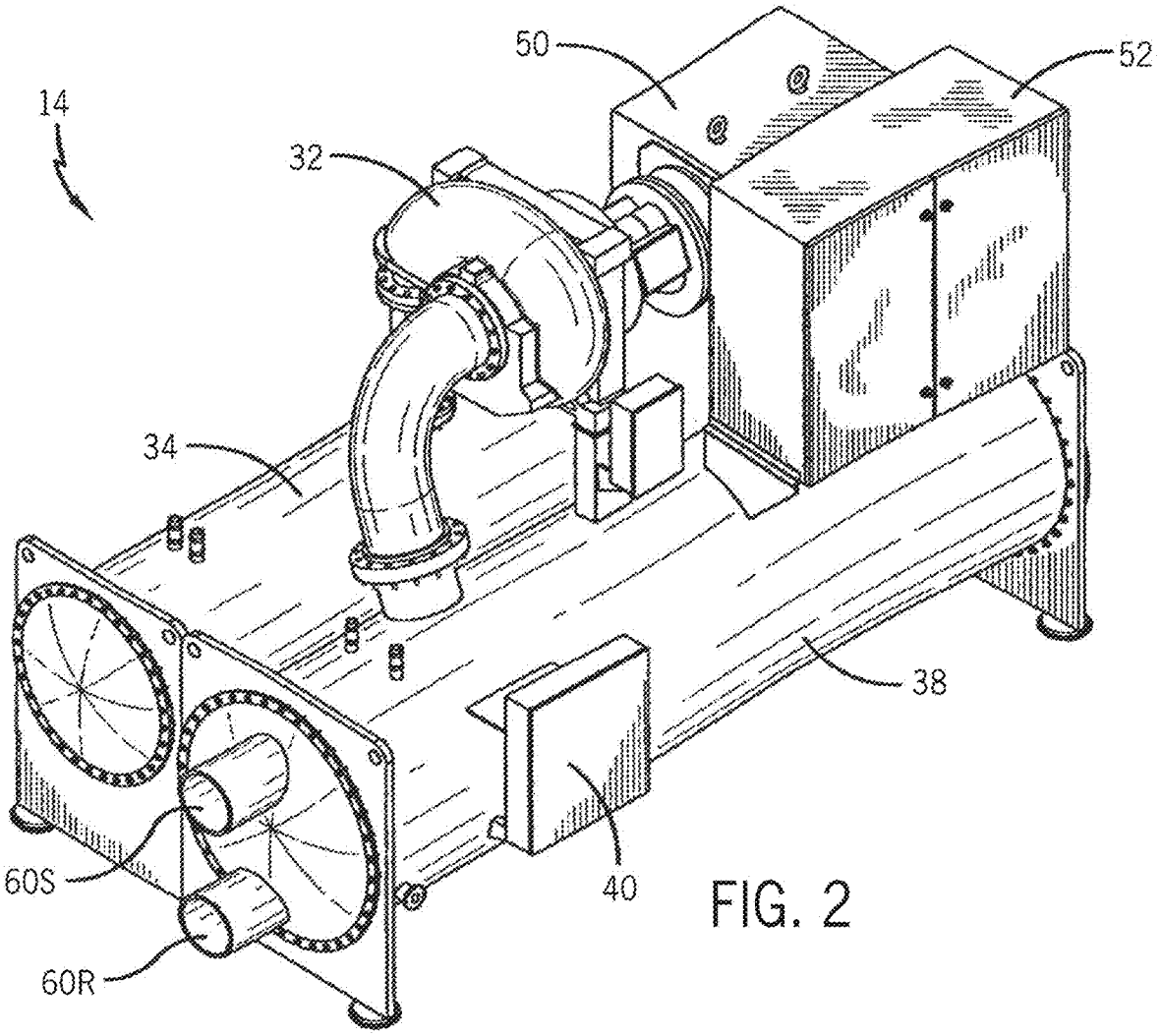
FIG. 2 is a perspective view of an embodiment of a vapor compression system, in accordance with an aspect of the present disclosure.
Figure 3:
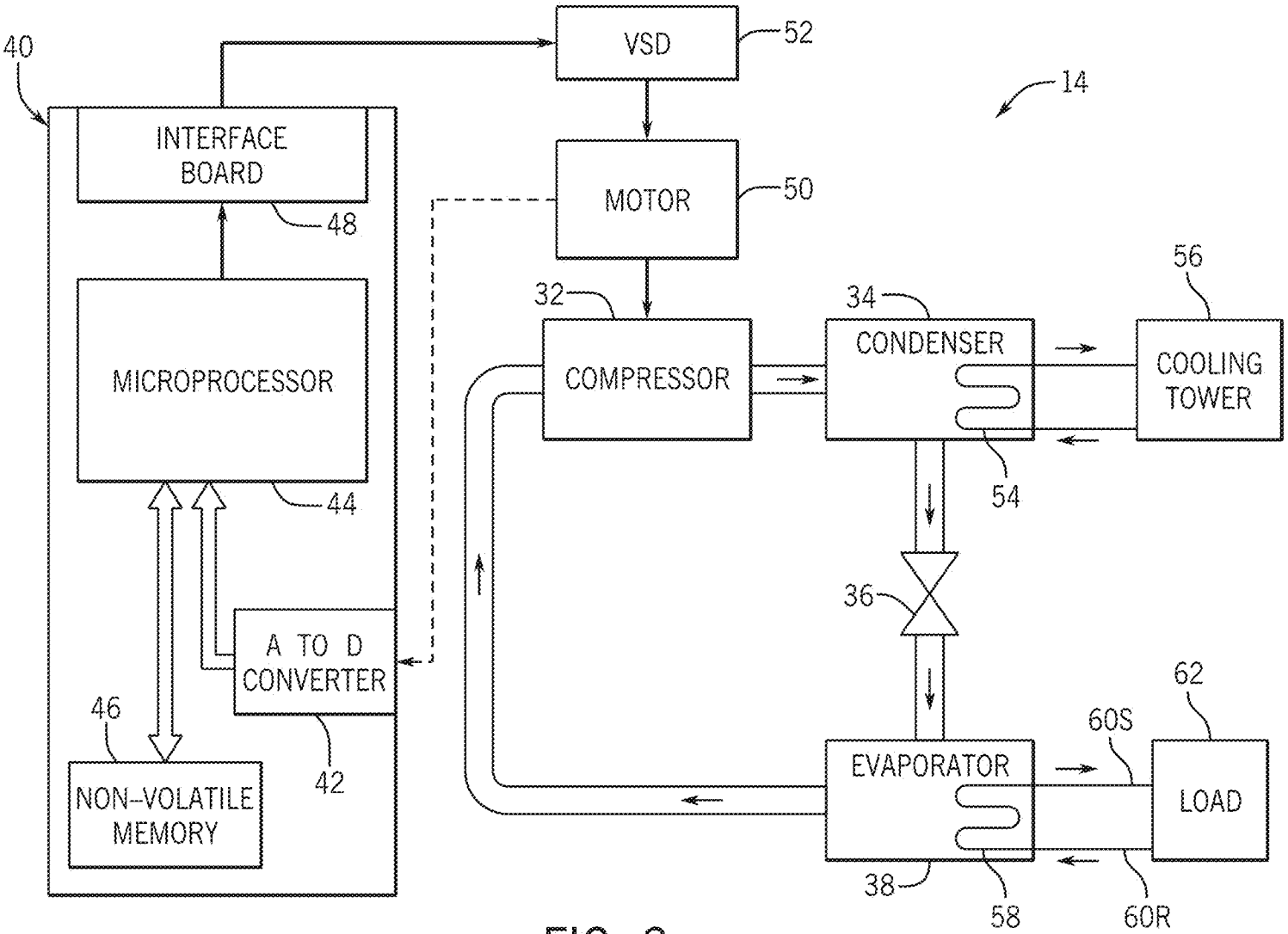
FIG. 3 is a schematic of an embodiment of the vapor compression system of FIG. 2, in accordance with an aspect of the present disclosure.

FIGS. 2 and 3 are embodiments of the vapor compression system 14 (e.g., vapor compression circuit) that can be used in the HVAC&R system 10. The vapor compression system 14 may circulate a refrigerant through a circuit starting with a compressor 32. The circuit may also include a condenser 34, an expansion valve(s) or device(s) 36, and a liquid chiller or an evaporator 38. The vapor compression system 14 may further include a control panel 40 that has an analog to digital (A/D) converter 42, a microprocessor 44, a non-volatile memory 46, and/or an interface board 48.

Some examples of fluids that may be used as refrigerants (e.g., working fluids) in the vapor compression system 14 are hydrofluorocarbon (HFC) based refrigerants, for example, R-410A, R-407, R-134a, R-1234ze, R1233zd, hydrofluoro olefin (HFO), "natural" refrigerants like ammonia (NH3), R-717, carbon dioxide (CO2), R-744, or hydrocarbon based refrigerants, water vapor, or any other suitable refrigerant. In some embodiments, the vapor compression system 14 may be configured to efficiently utilize refrigerants having a normal boiling point of about 19 degrees Celsius (66 degrees Fahrenheit) at one atmosphere of pressure, also referred to as low pressure refrigerants, versus a medium pressure refrigerant, such as R-134a. As used herein, "normal boiling point" may refer to a boiling point temperature measured at one atmosphere of pressure.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of motor that can be powered by a VSD or directly from an AC or DC power source, such as a switched reluctance motor, an induction motor, an electronically commutated permanent magnet motor, or another suitable motor.

The compressor 32 compresses a working fluid vapor and delivers the vapor to the condenser 34 through a discharge passage. In some embodiments, the compressor 32 may be a centrifugal compressor. The working fluid vapor delivered by the compressor 32 to the condenser 34 may transfer heat to a cooling fluid (e.g., water or air) in the condenser 34. The working fluid vapor may condense to a working fluid liquid in the condenser 34 as a result of thermal heat transfer with the cooling fluid. The liquid working fluid from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser 34.

The liquid working fluid delivered to the evaporator 38 may absorb heat from another cooling fluid, which may or may not be the same cooling fluid used in the condenser 34. The liquid working fluid in the evaporator 38 may undergo a phase change from the liquid working fluid to a working fluid vapor. As shown in the illustrated embodiment of FIG. 3, the evaporator 38 may include a tube bundle 58 having a supply line 60S and a return line 60R connected to a cooling load 62. The cooling fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the cooling fluid in the tube bundle 58 via thermal heat transfer with the working fluid. The tube bundle 58 in the evaporator 38 can include a plurality of tubes and/or a plurality of tube bundles. In any case, the vapor working fluid exits the evaporator 38 and returns to the compressor 32 by a suction line to complete the cycle.

Figure 4:
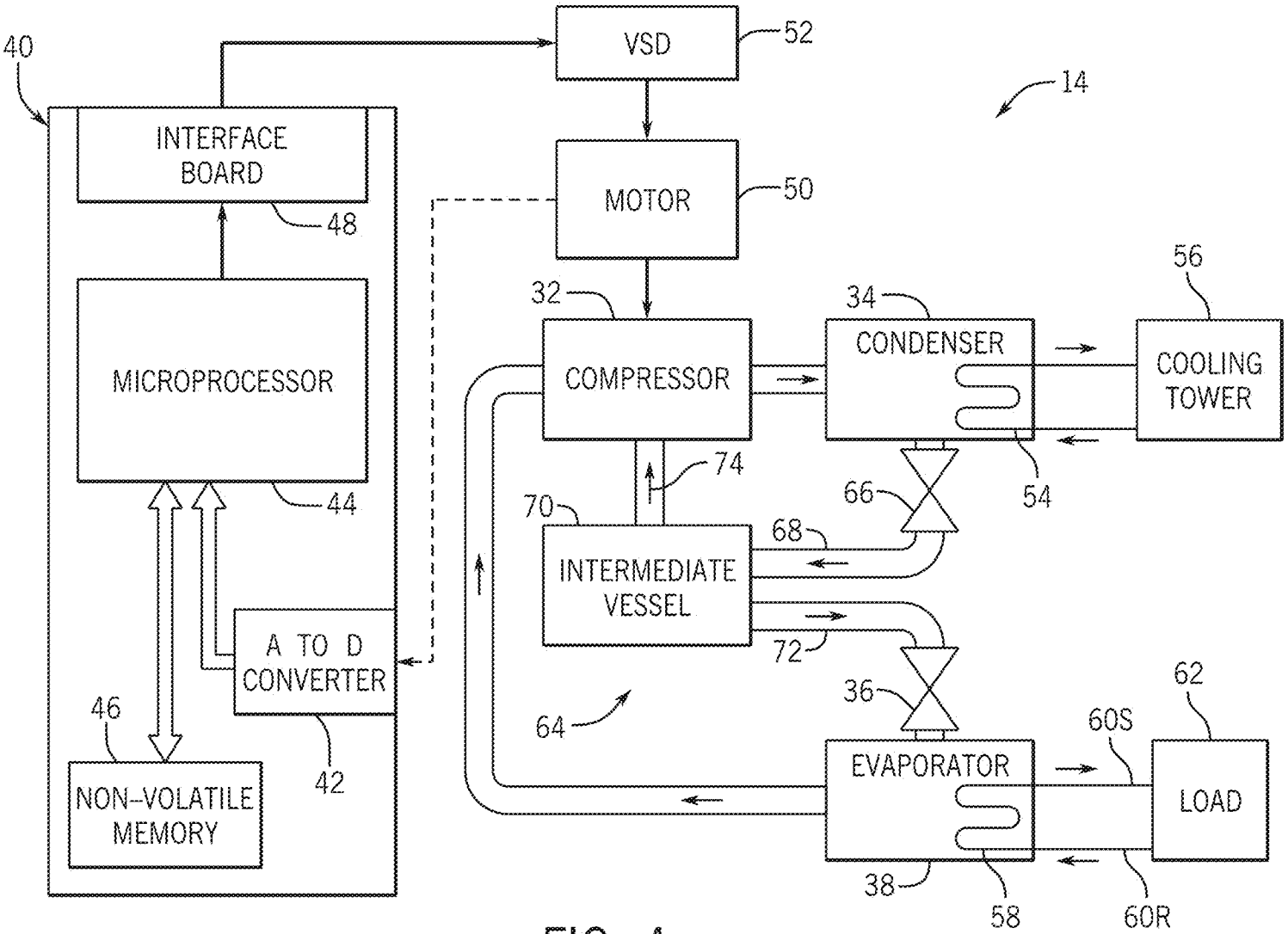
FIG. 4 is a schematic of an embodiment of the vapor compression system of FIG. 2, in accordance with an aspect of the present disclosure.

FIG. 4 is a schematic of the vapor compression system 14 with an intermediate circuit 64 incorporated between the condenser 34 and the expansion device 36. The intermediate circuit 64 may have an inlet line 68 (e.g., conduit) that is directly fluidly connected to the condenser 34. In other embodiments, the inlet line 68 may be indirectly fluidly coupled to the condenser 34. As shown in the illustrated embodiment of FIG. 4, the inlet line 68 includes a first expansion device 66 positioned upstream of an intermediate vessel 70. In some embodiments, the intermediate vessel 70 may be a flash tank (e.g., a flash intercooler, an economizer). In other embodiments, the intermediate vessel 70 may be configured as a heat exchanger or a "surface economizer." In the illustrated embodiment of FIG. 4, the intermediate vessel 70 is used as a flash tank, and the first expansion device 66 is configured to lower the pressure of (e.g., expand) the liquid working fluid received from the condenser 34. During the expansion process, a portion of the liquid may vaporize, and thus, the intermediate vessel 70 may be used to separate the vapor from the liquid received from the first expansion device 66.

Additionally, the intermediate vessel 70 may provide for further expansion of the liquid working fluid due to a pressure drop experienced by the liquid working fluid when entering the intermediate vessel 70 (e.g., due to a rapid increase in volume experienced when entering the intermediate vessel 70). The vapor in the intermediate vessel 70 may be drawn by the compressor 32 through a suction line 74 (e.g., conduit) of the compressor 32. In other embodiments, the vapor in the intermediate vessel may be drawn to an intermediate stage of the compressor 32 (e.g., not the suction stage). The liquid that collects in the intermediate vessel 70 may be at a lower enthalpy than the liquid refrigerant exiting the condenser 34 due to the expansion in the expansion device 66 and/or the intermediate vessel 70. The liquid from intermediate vessel 70 may then flow through a line 72 (e.g., conduit) and through a second expansion device 36 to the evaporator 38.

It should be appreciated that any of the features described herein may be incorporated with the vapor compression system 14 or any other suitable HVAC&R systems. For example, the present techniques may be incorporated with any HVAC&R system having an economizer, such as the intermediate vessel 70, and a compressor, such as the compressor 32. HVAC&R systems incorporating the present techniques may include water-cooled chillers, air-cooled chillers, heat pumps, and/or any other suitable HVAC&R system. The HVAC&R systems may utilize any suitable working fluid, such as one or more of the refrigerants discussed above or another working fluid.

As mentioned above, the present disclosure is directed to a vapor compression system that includes an economizer (e.g., an intermediate vessel) configured to receive working fluid from a condenser and to separate the working fluid into liquid working fluid and vapor working fluid. The economizer may direct the liquid working fluid to an evaporator of the vapor compression system to enable the evaporator to place the liquid working fluid in a heat exchange relationship with a cooling fluid to cool the cooling fluid. The economizer may be configured to induce and/or enable a swirling flow of the working fluid within the economizer. The swirling flow of working fluid be subjected to centrifugal acceleration forces that promote and/or induce separation of the working fluid into liquid working fluid and vapor working fluid. Indeed, by utilizing centrifugal acceleration forces to cause separation of the working fluid into liquid and vapor components, present economizers may have a more compact configuration (e.g., reduced physical footprint) compared to other existing economizers and/or may enable a reduction in an amount of working fluid utilized by the vapor compression system. In this way, present embodiments enable a reduction in costs associated with manufacture and operation of the vapor compression system.

Further, embodiments of the economizer disclosed herein may include multiple chambers configured to induce or enable the swirling flow of working fluid therein. Thus, the economizer may have multiple stages and may produce multiple flows of vapor working fluid (e.g., at different pressures) that may be directed to one or more compressors for pressurization. In this way, present embodiments also enable improved operation of the vapor compression system (e.g., increased efficiency) across a wider range of operating capacities of the vapor compression system. Additional features and benefits of the disclosed techniques are described in further detail below.

Figure 5:
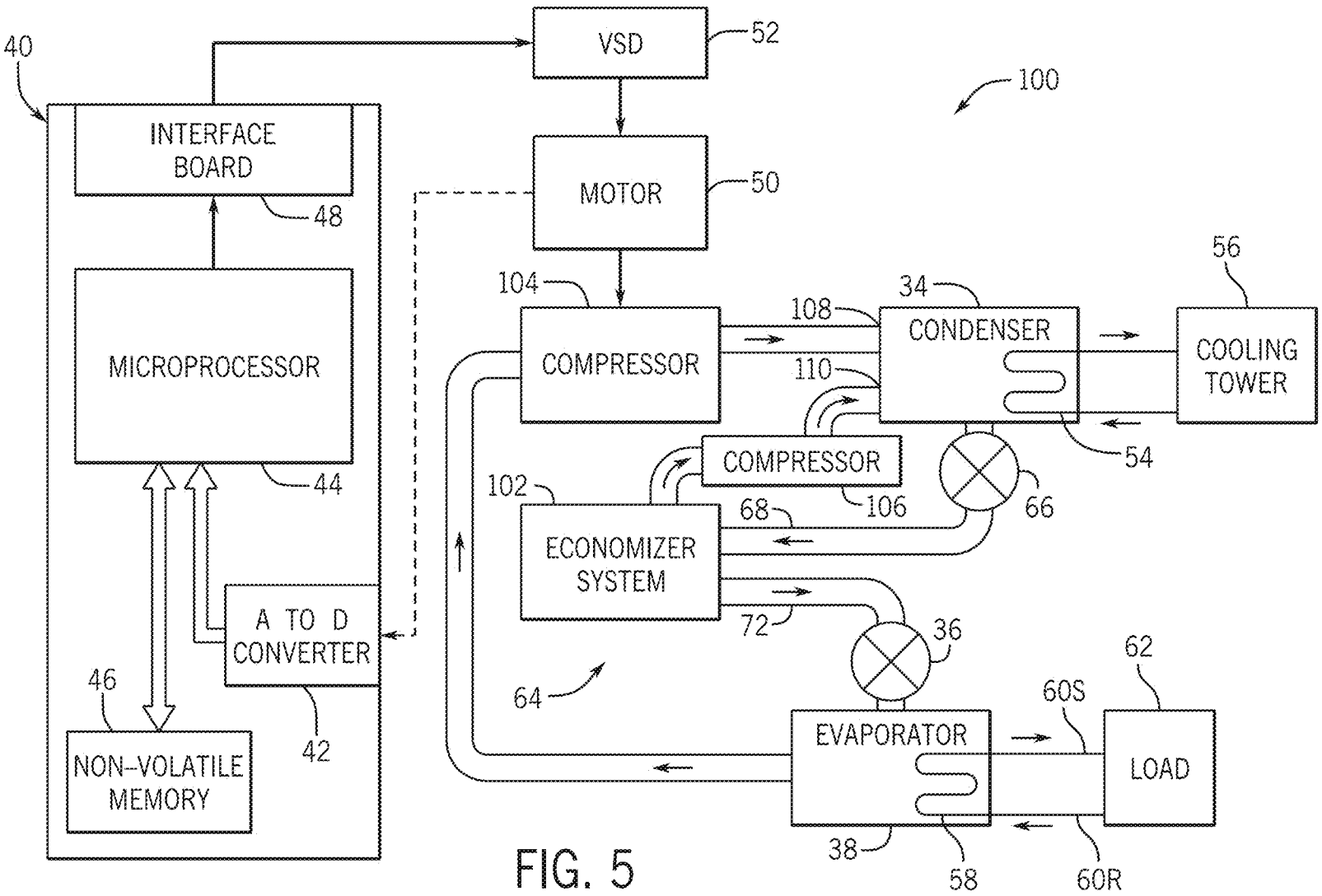
FIG. 5 is a schematic of an embodiment of the vapor compression system of FIG. 2, in accordance with an aspect of the present disclosure.

With the foregoing in mind, FIG. 5 is a schematic of an embodiment of a vapor compression system 100 that includes an economizer system 102 (e.g., economizer, intermediate vessel 70) in accordance with aspects of the present disclosure. The illustrated embodiment includes similar elements and element numbers as the embodiments described above with reference to FIGS. 3 and 4. The illustrated embodiment also includes a first compressor system 104 (e.g., the compressor 32, a main compressor, a primary compressor system) and a second compressor system 106 (e.g., an auxiliary compressor, an economizing compressor, a secondary compressor system. As similarly described above, the first compressor system 104 is configured to receive (e.g., draw) a flow of the working fluid from the evaporator 38, pressurize the working fluid, and direct the pressurized working fluid to the condenser 34. For example, the first compressor system 104 may direct pressurized working fluid to a first condenser inlet 108 of the condenser 34. The first compressor system 104 may include the compressor 32, one or more additional compressors, one or more multi-stage compressors, and/or any other suitable compressor configured to compress the working fluid.

The second compressor system 106 is configured to receive (e.g., draw) vapor working fluid from the economizer system 102, pressurize the vapor working fluid, and direct the pressurized working fluid to the condenser 34. For example, the second compressor system 106 may direct the pressurized working fluid to a second condenser inlet 110 of the condenser 34. In some embodiments, the second compressor system 106 may direct pressurized working fluid to the first compressor system 104 (e.g., to an intermediate stage of the first compressor system 104). The second compressor system 106 may include one or more compressors (e.g., auxiliary compressors), such as one or more single stage compressors, one or more multi-stage compressors, and/or any other suitable compressor.

Figure 6:
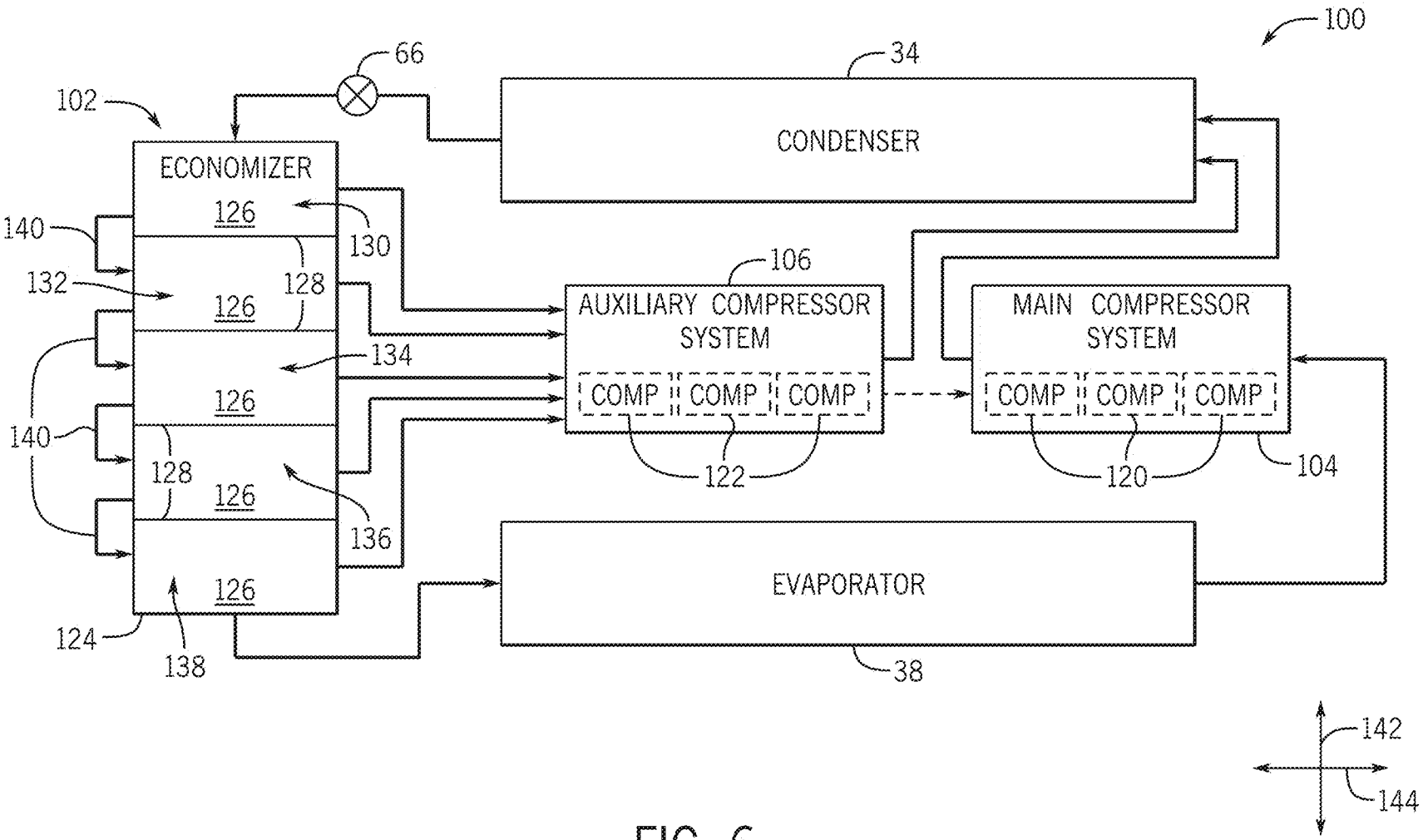
FIG. 6 is a schematic of an embodiment of a vapor compression system including an economizer system, in accordance with an aspect of the present disclosure.

FIG. 6 is a schematic of an embodiment of the vapor compression system 100 (e.g., vapor compression circuit) including the economizer system 102, in accordance with the present techniques. The illustrated embodiment includes similar elements and element numbers as the embodiments described above with reference to FIG. 5. For example, the vapor compression system 100 includes the condenser 34, the evaporator 38, the first compressor system 104, and the second compressor system 106. In the illustrated embodiment, the first compressor system 104 is a main compressor system including one or more main compressors 120 (e.g., primary compressors). The one or more main compressors 120 may be single stage compressors, multi-stage compressors, or a combination thereof. The main compressors 120 may be arranged in series or in parallel with one another. As shown, the first compressor system 104 receives working fluid from the evaporator 38 and directs working fluid to the condenser 34.

The second compressor system 106 is an auxiliary compressor system including one or more auxiliary compressors 122 (e.g., secondary compressors). The one or more auxiliary compressors 122 may be single stage compressors, multi-stage compressors, or a combination thereof, and the auxiliary compressors 122 may be arranged in series or in parallel with one another. As shown, the second compressor system 106 receives working fluid from the economizer system 102 and directs working fluid to the condenser 34. However, in some embodiments, the second compressor system 106 may direct working fluid to the first compressor system 104, such as to an intermediate stage of the first compressor system 104 (e.g., upstream of one of the main compressors 120 and downstream of another of the main compressors 120). Further, the second compressor system 106 may receive multiple flows of working fluid from the economizer system 102. As described in further detail below, the economizer system 102 may include multiple chambers, with each chamber configured to separate working fluid into a liquid working fluid and a vapor working fluid. Thus, the economizer system 102 may discharge multiple flows of vapor working fluid, which may be directed to the second compressor system 106.

The economizer system 102 is configured to receive a flow of working fluid from the condenser 34 (e.g., from an expansion device, such as the first expansion device 66, disposed downstream of the condenser 34). The economizer system 102 (e.g., economizer) includes a housing 124 (e.g., shell) configured to receive the working fluid from the condenser 34. In the illustrated embodiment, the housing 124 defines multiple chambers 126 (e.g., flash chambers, economizer chambers) of the economizer system 102. Each chamber 126 is configured to receive a flow of working fluid and to separate the working fluid into liquid working fluid and vapor working fluid. Specifically, each chamber 126 is configured to receive a respective flow of working fluid and separate the respective flow of working fluid into respective amounts of liquid working fluid and vapor working fluid. To this end, each chamber 126 may be separated from other chambers 126 by separation plates 128 extending within the housing 124. Each chamber 126 may generally define a separate economizer stage of the economizer system 102. Additional details regarding the configuration and operation of the chambers 126 are described in further detail below.

As shown, vapor working fluid may be directed from each chamber 126 to the second compressor system 106. Liquid working fluid may be directed from each chamber 126 to another chamber 126 of the economizer system 102 or to the evaporator 38. For example, in the illustrated embodiment, the economizer system 102 includes a first chamber 130 configured to receive a flow of working fluid from the condenser 34 or expansion device 66. The first chamber 130 may separate the flow of working fluid into vapor working fluid, which may be directed to the second compressor system 106, and liquid working fluid. The liquid working fluid within the first chamber 130 may be directed from the first chamber 130 to a second chamber 132. The liquid working fluid received by the second chamber 132 may be separated into vapor working fluid and liquid working fluid components, the vapor working fluid may be directed to the second compressor system 106, and the liquid working fluid may be directed to a third chamber 134 of the economizer system 102. The third chamber 134 may operate in a similar manner and may direct vapor working fluid to the second compressor system 106 and liquid working fluid to a fourth chamber 136, and the fourth chamber 136 may similarly direct vapor working fluid to the second compressor system 106 and liquid working fluid to a fifth chamber 138. The fifth chamber 138 is configured to direct vapor working fluid to the second compressor system 106 and liquid working fluid to the evaporator 38. While the illustrated embodiment of the economizer system 102 includes five chambers 126 configured to receive working fluid and separate the working fluid into vapor and liquid components, it should be appreciated that other embodiments of the economizer system 102 may define or include any other suitable number of chambers 126 (e.g., two, three, four, six, or more).

As described in further detail below, the economizer system 102 may include one or more conduits 140 (e.g., outlet conduits) configured to direct liquid working fluid from one chamber 126 to another chamber 126. The one or more conduits 140 may fluidly couple multiple chambers 126 to enable flow of liquid working fluid therebetween, and, in some embodiments, the conduits 140 may extend external to the housing 124. The conduits 140 may also be configured to induce, facilitate, or otherwise enable a swirling flow of the working fluid within each chamber 126. Thus, the economizer system 102 may be considered a "cyclonic" economizer that causes separation of working fluid into liquid working fluid and vapor working fluid via application of centrifugal acceleration forces to the working fluid within the chambers 126. As will be appreciated, the economizer system 102 incorporating these techniques may be manufactured in a more compact manner, which may reduce costs associated with the manufacture of the economizer system 102. Additionally, the economizer system 102 with the compact configuration may enable utilization of a reduced amount of working fluid in the vapor compression system 100, which may further reduce costs associated with manufacture and operation of the vapor compression system 100.

Moreover, in some embodiments, the economizer system 102 may be arranged or installed with the vapor compression system 100 in an orientation that enables more efficient use of space by the components of the vapor compression system 100. For example, the orientation of the economizer system 102 may enable more compact packaging of the vapor compression system 100 and components thereof. The arrangement of the economizer system 102 may also enable improved operation of the vapor compression system 100. To facilitate the discussion below, components of the vapor compression system 100, including the economizer system 102, may be described with reference to a vertical axis 142 (e.g., a first axis) and/or a horizontal axis 144 (e.g., a second axis). As will be appreciated, the vertical axis 142 may generally extend in a direction of gravity, while the horizontal axis 144 may extend generally crosswise (e.g., perpendicularly) to the direction of gravity.

In the illustrated embodiment, the economizer system 102 is arranged in a generally vertical configuration. That is, the housing 124 (e.g., shell) of the economizer system 102 is arranged such that the chambers 126 defined by the housing 124 are stacked on top of one another and/or are arrayed along the vertical axis 142. Conversely, the condenser 34 and the evaporator 38 (e.g., respective shells and/or housings of the condenser 34 and evaporator 38) are arranged to extend generally along the horizontal axis 144. That is, in an installed or assembled configuration of the vapor compression system 100, the condenser 34 and the evaporator 38 may be oriented to extend generally along the horizontal axis 144, while the economizer system 102 (e.g., the housing 124) is oriented to extend generally along the vertical axis 142, with the first chamber 130 being an uppermost chamber within the housing 124 and the fifth chamber 138 being a lowermost chamber within the housing 124. As a result, the economizer system 102 may utilize the force of gravity to at least partially enable flow of working fluid through the economizer system 102. For example, the force of gravity may at least partially promote flow of liquid working fluid through one of the conduits 140 from the first chamber 130 to the second chamber 132. Similarly, the force of gravity may at least partially promote flow of liquid working fluid from the second chamber 132 to the third chamber 134 via one of the conduits 140, from the third chamber 134 to the fourth chamber 136 via another one of the conduits 140, and so on. In the generally vertically orientation, the economizer system 102 may occupy a smaller physical footprint then exiting economizers having multiple chambers.

Figure 7:
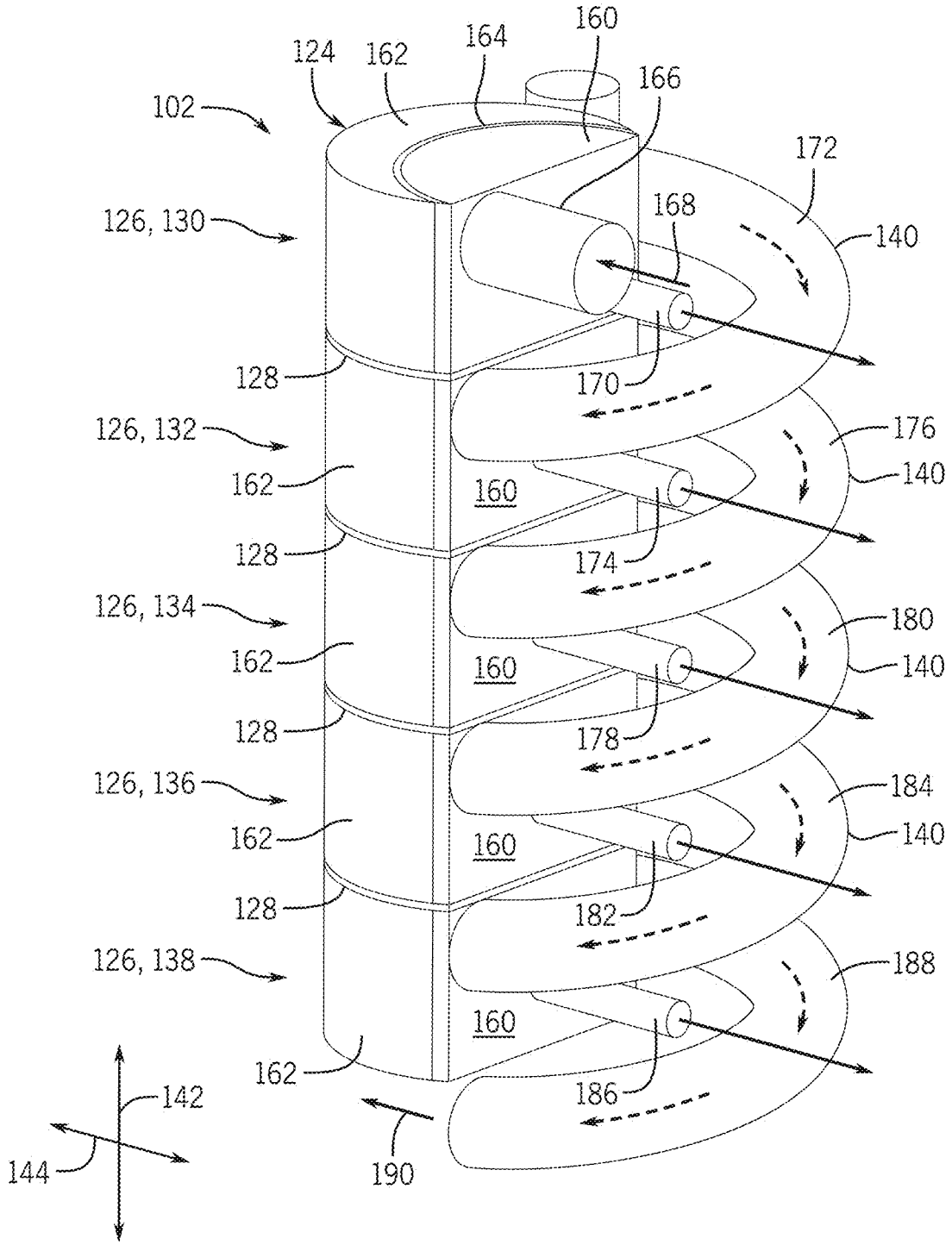
FIG. 7 is a perspective view schematic of an embodiment of an economizer having multiple chambers, in accordance with an aspect of the present disclosure.

FIG. 7 is a perspective view schematic of an embodiment of the economizer system 102 having the multiple chambers 126, in accordance with aspects of the present disclosure. The economizer system 102 is shown in a generally vertical orientation (e.g., vertical, installed configuration), whereby the chambers 126 within the housing 124 are arrayed along the vertical axis 142 (e.g., the chambers 126 stacked vertically along the vertical axis 142). As described above, the chambers 126 within the housing 124 may be separated within the housing 124 by the separation plates 128 (e.g., rigid plates) extending within the housing 124. The separation plates 128 block working fluid flow from one chamber 126 to another chamber 126 within the housing 124. In the illustrated vertical orientation of the economizer system 102, the separation plates 128 are horizontal separation plates that extend generally along the horizontal axis 144 (e.g., in a generally horizontal direction) within the housing 124 to separate the chambers 126 from one another within the housing 124. In other embodiments, the separation plates 128 may be disposed at an angle (e.g., an acute angle) relative to the horizontal axis 144.

Each chamber 126 within the housing 124 may further include a respective first section 160 and a respective second section 162. The first section 160 and second section 162 may be at least partially defined by a perforated sheet 164 (e.g., perforated plate, curved perforated sheet, porous member, perforated member, a curved surface) extending within the corresponding chamber 126. In some embodiments, one perforated sheet 164 (e.g., a continuous sheet) may extend within the housing 124 and within each of the chambers 126. In such an embodiment, the perforated sheet 164 may extend through the separation plates 128. In other embodiments, multiple perforated sheets 164 may be incorporated within the housing 124, with each perforated sheet 164 extending within one of chambers 126 to define the first section 160 and the second section 162 of the corresponding chamber 126. The first section 160 of each chamber 126 may be a two-phase section of the corresponding chamber 126, and the second section 162 may be a liquid collection section of the corresponding chamber 126. In the manner described below, the first section 160 of each chamber 126 is configured to receive a flow of working fluid (e.g., two-phase working fluid), and the second section 162 of each chamber 126 is configured to collect and discharge liquid working fluid separated from vapor working fluid within the corresponding chamber 126. The vapor working fluid may therefore be discharged from the first section 160 of the corresponding chamber 126.

As discussed above, the economizer system 102 is configured to receive a flow of working fluid from the condenser 34 and/or an expansion device (e.g., first expansion device 66) of the vapor compression system 100. Accordingly, the economizer system 102 includes an inlet conduit 166 configured to direct a flow of working fluid into the housing 124. Specifically, in the illustrated embodiment, the inlet conduit 166 is configured to direct a flow of working fluid into the first section 160 of the first chamber 130, as indicated by arrow 168. As discussed in further detail below, the inlet conduit 166 may direct the working fluid into the first section 160 of the first chamber 130 to induce or enable a swirling flow (e.g., circular flow) of the working fluid (e.g., two-phase mixture of working fluid) within the first chamber 130, which may promote or facilitate separation of the working fluid into vapor working fluid and liquid working fluid. As the working fluid is separated into liquid and vapor components within the first chamber 130, the liquid working fluid may flow across the perforated sheet 164 within the first chamber 130 and may collect within the second section 162 of the first chamber 130. The vapor working fluid may collect within the first section 160 of the first chamber 130.

Vapor working fluid collected within the first section 160 of the first chamber 130 may be discharged from the housing 124 via a first vapor outlet conduit 170. As discussed above, the vapor working fluid may be directed to the second compressor system 106 (e.g., via the first vapor outlet conduit 170), such as to one of the auxiliary compressors 122 corresponding to the first chamber 130 (e.g., first economizer stage). Liquid working fluid collected within the second section 162 of the first chamber 130 may be discharged from the first chamber 130 via a first liquid outlet conduit 172 (e.g., one of the conduits 140, curved conduit) of the economizer system 102. As shown, the first liquid outlet conduit 172 extends from the second section 162 of the first chamber 130 to the first section 160 of the second chamber 132 to fluidly couple the second section 162 of the first chamber 130 with the first section 160 of the second chamber 132. As similarly discussed above, the first liquid outlet conduit 172 may extend externally to the housing 124 of the economizer system 102. Additionally, in the vertical orientation of the economizer system 102, the first liquid outlet conduit 172 extends at least partially at a downward angle, relative to the vertical axis 142. In this way, the force of gravity may be utilized to at least partially promote flow of liquid working fluid from the first chamber 130 to the second chamber 132 via the first liquid outlet conduit 172. Furthermore, the first liquid outlet conduit 172 extends at least partially about (e.g., circumferentially about) the housing 124, which may further induce, promote, or otherwise enable flow of the working fluid in a swirling motion or flow pattern within the second chamber 132. That is, the first liquid outlet conduit 172 is curved to direct the liquid working fluid circumferentially about the housing 124 in a swirling or circular flow pattern.

Operation of the second chamber 132 may be similar to operation of the first chamber 130 discussed above. The flow of working fluid received by the second chamber 132 may be separated into liquid working fluid and vapor working fluid, the vapor working fluid may be collected within the first section 160 of the second chamber 132, and the liquid working fluid may be collected within the second section 162 of the second chamber 132. Accordingly, the economizer system 102 includes a second vapor outlet conduit 174 configured to discharge vapor working fluid from the second chamber 132 and includes a second liquid outlet conduit 176 (e.g., curved conduit) configured to discharge liquid working fluid from the second section 162 of the second chamber 132. The second vapor outlet conduit 174 may direct vapor working fluid to the second compressor system 106, such as to one of the auxiliary compressors 122 corresponding to the second chamber 132 (e.g., second economizer stage). The second liquid outlet conduit 176 extends externally to the housing 124 (e.g., at least partially at a downward angle relative to the vertical axis 142) and extends from the second section 162 of the second chamber 132 to the first section 160 of the third chamber 134. The second liquid outlet conduit 176 also extends about (e.g., circumferentially about) the housing 124, which may further induce, promote, or otherwise enable flow of the working fluid in a swirling motion or flow pattern within the third chamber 134. That is, second liquid outlet conduit 176 is curved to direct the liquid working fluid circumferentially about the housing 124 in a swirling or circular flow pattern.

Operation of the third chamber 134, fourth chamber 136, and fifth chamber 138 may be similar to operation of the first chamber 130 and second chamber 132 discussed above. Accordingly, the economizer system 102 includes a third vapor outlet conduit 178 configured to discharge vapor working fluid from the first section 160 of the third chamber 134 (e.g., toward one of the auxiliary compressors 122 corresponding to the third chamber 134 or third economizer stage) and includes a third liquid outlet conduit 180 extending externally to the housing 124 (e.g., at least partially at a downward angle relative to the vertical axis 142), about the housing 124, and from the second section 162 of the third chamber 134 to the first section 160 of the fourth chamber 136. The economizer system 102 also includes a fourth vapor outlet conduit 182 configured to discharge vapor working fluid from the first section 160 of the fourth chamber 136 (e.g., toward one of the auxiliary compressors 122 corresponding to the fourth chamber 136 or fourth economizer stage) and includes a fourth liquid outlet conduit 184 extending externally to the housing 124 (e.g., at least partially at a downward angle relative to the vertical axis 142), about the housing 124, and from the second section 162 of the fourth chamber 136 to the first section 160 of the fifth chamber 138. The economizer system 102 further includes a fifth vapor outlet conduit 186 configured to discharge vapor working fluid from the first section 160 of the fifth chamber 138 (e.g., toward one of the auxiliary compressors 122 corresponding to the fifth chamber 138 or fifth economizer stage). A fifth liquid outlet conduit 188 extends from the second section 162 of the fifth chamber 138 and is configured to direct liquid working fluid collected within the second section 162 of the fifth chamber 138 toward the evaporator 38, as indicated by arrow 190.

In some embodiments, one or more of the vapor outlet conduits 170, 174, 178, 182, and 186 may extend from the corresponding chamber 126 at least partially in an upward direction (e.g., along the vertical axis 142). As a result, any liquid working fluid entrained within the vapor working fluid collected within the first section 160 of the corresponding chamber 126 may impinge against the vapor outlet conduit 170, 174, 178, 182, and 186 and may be redirected back into the corresponding chamber 126 for further separation from the vapor working fluid. Additional details and features of the economizer system 102 are described further below.

Figure 8:
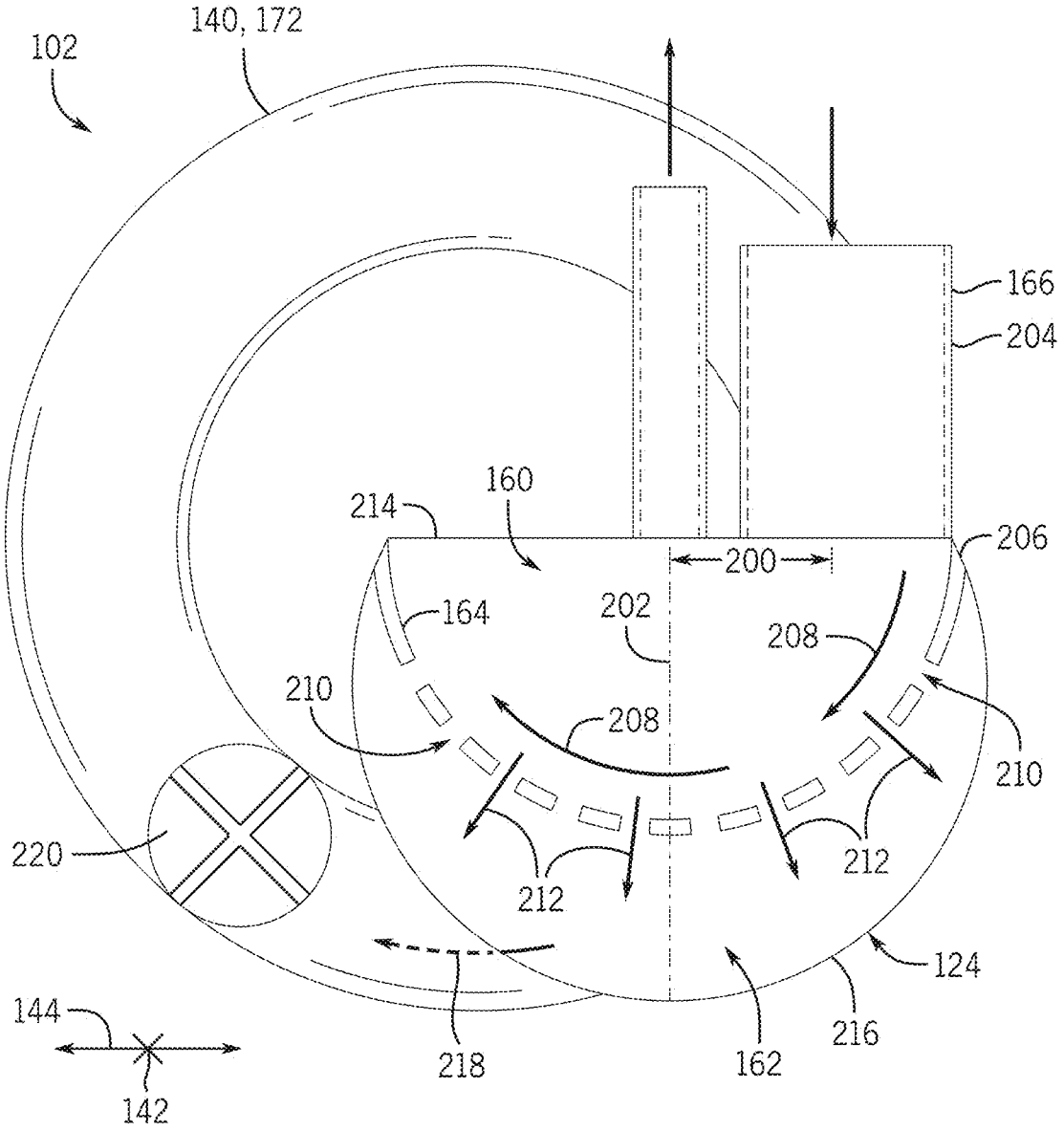
FIG. 8 is an axial view schematic of an embodiment of an economizer, in accordance with an aspect of the present disclosure.

FIG. 8 is an axial view schematic of an embodiment of the economizer system 102, illustrating flow and separation of working fluid within the first chamber 130 of the economizer system 102. As previously discussed, the economizer system 102 includes the inlet conduit 166 configured to direct a flow of working fluid from the condenser 34 and or first expansion device 66 into the first chamber 130 within the housing 124. The flow of working fluid received via the inlet conduit 166 may be a two-phase mixture of working fluid. In some embodiments, control of the first expansion device 66 may be regulated to achieve a desired gas-liquid mixture of working fluid directed into the first chamber 130 of the economizer system 102.

As briefly discussed above, the economizer system 102 is configured to induce and enable a swirling flow (e.g., circular flow) of the working fluid within the chambers 126. By inducing a swirling or circular flow pattern, centrifugal acceleration forces may be imparted to the working fluid, which may promote separation of the working fluid into liquid fluid and vapor fluid components. Additionally, such operation of the economizer system 102 may enable more compact configurations of the economizer system 102, which may reduce costs associated with manufacture of the economizer system 102 and may also reduce an amount of working fluid utilized by the vapor compression system 100 having the economizer system 102, thereby further reducing manufacturing and operating costs.

The economizer system 102 may include various features or configurations to enable the swirling or circular flow pattern of the working fluid. For example, each chamber 126 defined by the economizer system 102 may have one or more curved surfaces configured to guide flow of the working fluid received by the chamber 126 in a swirling, circular, or rotational flow pattern. In some embodiments, the housing 124 of the economizer system 102 may be generally cylindrical in shape and may define one or more of the curved surfaces. The perforated sheet 164 may also have a curved configuration or profile. Thus, the perforated sheet 164 may guide flow of the working fluid received by each chamber 126 in a swirling (e.g., rotational) motion or pattern. The configuration or arrangement of the conduits 140 (e.g., first liquid outlet conduit 172) may also facilitate flow of working fluid within the chambers 126 in a swirling or circular pattern.

In the illustrated embodiment, the inlet conduit 166 is fluidly coupled to the first chamber 130 of the economizer system 102 and is configured to direct a flow of working fluid into the first section 160 of the first chamber 130. In particular, the inlet conduit 166 is coupled to the housing 124 at an offset distance 200 from a center or centerline 202 (e.g., diameter) of the first chamber 130 (e.g., along the horizontal axis 144). In some embodiments, an axis of the inlet conduit 166 may be aligned with or may extend adjacent (e.g., within 1, 5, or 10 percent of a diameter dimension of the housing 124) a tangent line of an outer diameter or a circumference of the housing 124 and/or perforated sheet 164. The inlet conduit 166 may have a constant (e.g., circular) cross-section or a variable cross-section. For example, the cross-section of the inlet conduit 166 may be elliptical at a connection between the inlet conduit 166 and the housing 124. In some embodiments, an outer surface 204 of the inlet conduit 166 may extend along and/or be flush with an outer diameter or circumference 206 (e.g., outer surface) of the housing 124 and/or the perforated sheet 164. Thus, flow of working fluid directed into the first chamber 130 of the economizer system 102 may be readily directed along the curvature of perforated sheet 164 within the first chamber 130. In other words, the working fluid may tangentially impinge against the perforated sheet 164 and may be directed to flow along the perforated sheet 164 in a generally circular direction within the first chamber 130, as indicated by arrows 208 (e.g., in a circular direction, in a clockwise direction, in a cyclonic flow pattern). Thus, the economizer system 102 may induce and enable a swirling flow of the working fluid within the first section 160 of the first chamber 130. It should be appreciated that the conduits 140 may be similarly coupled to corresponding chambers 126 to direct working fluid into the chambers 126. That is, an outlet end of each conduit 140 may be coupled the first section 160 of one of the chambers 126 to direct the working fluid to tangentially impinge against the perforated sheet 164 within the first section 160 of the corresponding chamber 126 to induce the swirling motion of the working fluid therein.

As the working fluid swirls within the first section 160, centrifugal acceleration forces may act on the working fluid. As a result, liquid working fluid (e.g., liquid droplets) may flow across the perforated sheet 164 from the first section 160 to the second section 162 of the first chamber 130. That is, liquid working fluid may flow through openings 210 formed in the perforated sheet 164, as indicated by arrows 212. Sizes, spaces, orientations, angles, and/or other characteristics of the openings 210 may be selected based on various operating parameters of the economizer system 102 and/or the vapor compression system 100, such as vapor and/or liquid content of the working fluid flow, amount of working fluid within the economizer system 102 and/or vapor compression system 100, and so forth. Vapor working fluid may remain within the first section 160 of the first chamber 130. In this way, liquid working fluid and vapor working fluid may be separated from one another in the first chamber 130, with the liquid working fluid collecting within the second section 162 of the first chamber 130.

In the illustrated embodiment, the first section 160 of the first chamber 130 has a generally semicircular cross-section (e.g., relative to the vertical axis 142). As shown, the first section 160 is generally defined by the perforated sheet 164 and a first panel 214 (e.g., housing panel, flat panel, etc.) of the housing 124. In other embodiments, the first section 160 may have a generally circular cross-section. For example, the first panel 214 of the housing 124 may have a generally semicircular geometry that, with the perforated sheet 164, may cooperatively define a circular cross-sectional geometry of the first section 160. As shown, the second section 162 of the first chamber 130 may have a generally crescent-shaped cross-sectional geometry (e.g., relative to the vertical axis 142). For example, the perforated sheet 164 and a second panel 216 (e.g., housing panel, curved panel) of the housing 124 may cooperatively define the crescent-shaped cross-sectional geometry of the second section 162. The second panel 216 may have a radius of curvature greater than a radius of curvature of the perforated sheet 164.

The second panel 216 of the housing 124 may also guide flow of liquid working fluid from the second section 162 into the first liquid outlet conduit 172. For example, a curved geometry of the second panel 216 may guide the liquid working fluid, which may flow in the induced swirling motion or circular direction, into the first liquid outlet conduit 172, as indicated by arrow 218 (e.g., in the same circular direction or clockwise direction as arrow 208). The first liquid outlet conduit 172 may also curve from the second section 162 of the first chamber 130 to the first section 160 of the second chamber 132, as discussed above. Indeed, the first liquid outlet conduit 172 may extend external to the housing 124 and may curve generally about the housing 124. In this way, the swirling flow of the working fluid (e.g., liquid working fluid) from the first chamber 130 to the second chamber 132 is enabled by the economizer system 102. Similar to the inlet conduit 166, the first liquid outlet conduit 172 may couple to the housing 124 to direct the liquid working fluid into the first section 160 of the second chamber 132, such that the liquid working fluid tangentially impinges against the perforated sheet 164 within the second chamber 132 and flows along the perforated sheet 164 with the swirling flow pattern.

In the illustrated embodiment, the first liquid outlet conduit 172 also includes a first expansion device 220 (e.g., expansion valve) disposed along the first liquid outlet conduit 172. The first expansion device 220 may be controlled to adjust a pressure of the liquid working fluid discharged from the second section 162 of the first chamber 130. In some embodiments, the first expansion device 220 may be controlled to cause the liquid working fluid to change to a vapor-liquid mixture of working fluid, which may enable further separation of the working fluid into vapor working fluid and liquid working fluid in the second chamber 132. In some embodiments, the first expansion device 220 may be controlled based on a detected level of the liquid working fluid within the second section 162 of the first chamber 130. As described in further detail below, each conduit 140 may include a corresponding expansion device to enable similar functionality for each conduit 140 and the respective flows of liquid working fluid directed therethrough.

Figure 9:
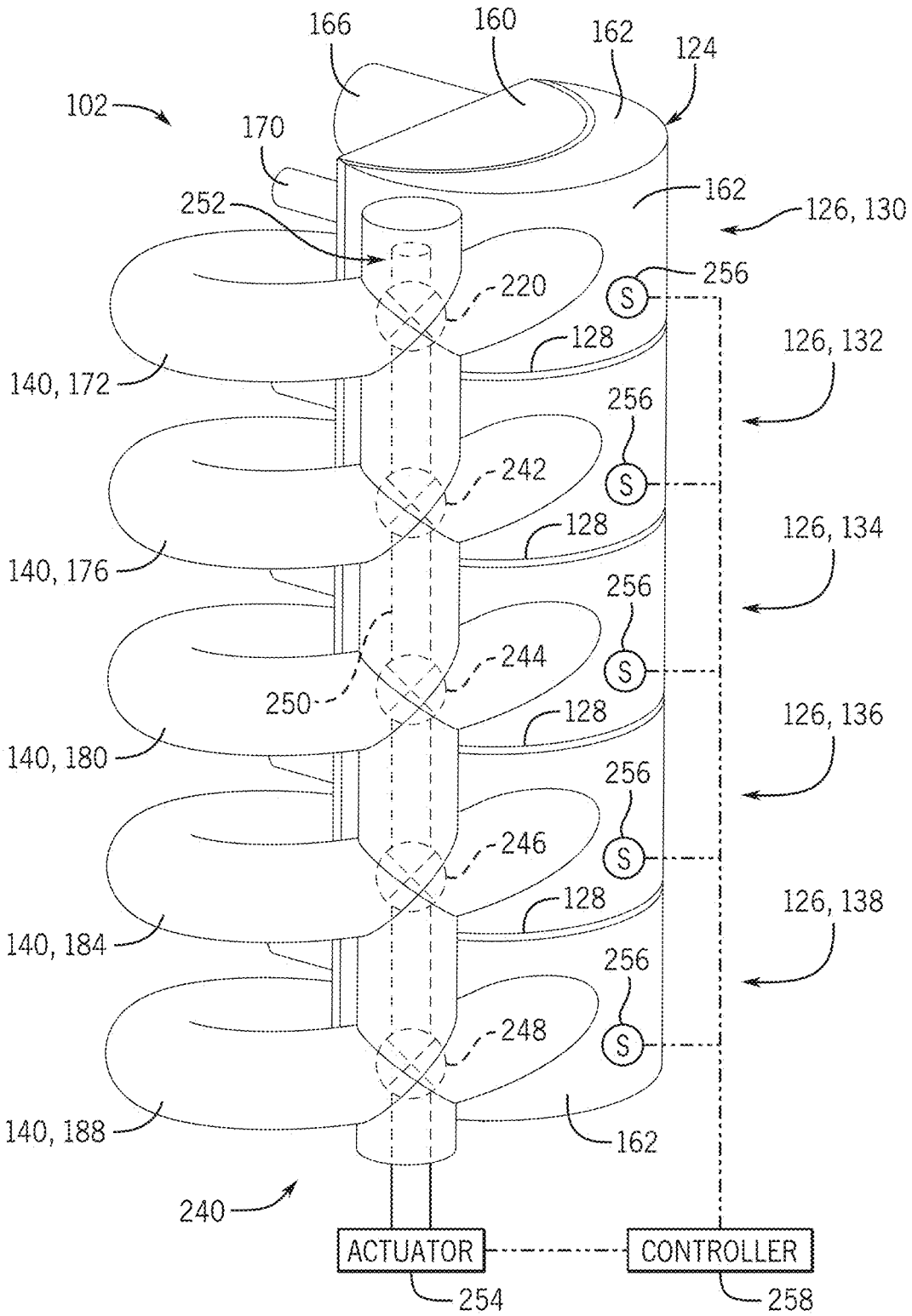
FIG. 9 is a perspective view schematic of an embodiment of an economizer having multiple chambers, in accordance with an aspect of the present disclosure.

FIG. 9 is a perspective view schematic of an embodiment of the economizer system 102, illustrating a vertical orientation or arrangement of the economizer system 102. The economizer system 102 also includes an expansion device system 240 of the economizer system 102. As mentioned above, the first liquid outlet conduit 172 may include the first expansion device 220 disposed along the first liquid outlet conduit 172, and the first expansion device 220 may be controlled to adjust flow of the liquid working fluid from the first chamber 130 to the second chamber 132. For example, the first expansion device 220 may be controlled to reduce a pressure (e.g., flash) of the liquid working fluid discharged from the first chamber 130 and/or to convert the liquid working fluid into a vapor-liquid mixture upstream of the second chamber 132. The second liquid outlet conduit 176, the third liquid outlet conduit 180, the fourth liquid outlet conduit 184, and the fifth liquid outlet conduit 188 may similarly include a second expansion device 242, a third expansion device 244, a fourth expansion device 246, and a fifth expansion device 248, respectively.

In some embodiments, the expansion devices 220, 242, 244, 246, and 248 are coupled to a common shaft 250 (e.g., a hollow shaft). In some embodiments, the expansion devices 220, 242, 244, 246, and 248 are integrally formed in the common shaft 250. The common shaft 250 may extend through an external housing 252 that is external to the housing 124 of the economizer system 102. In some embodiments, the external housing 252 may be excluded, and the common shaft 250 may nevertheless be disposed external to the housing 124. The common shaft 250 may be coupled to an actuator 254 configured to rotate the common shaft 250 and thereby adjust a position of the expansion devices 220, 242, 244, 246, and 248 simultaneously. In this way, control of the economizer system 102 may be simplified. However, in other embodiments, the expansion devices 220, 242, 244, 246, and 248 may each be controlled by a dedicated or respective actuator. In addition to controlling the expansion devices 220, 242, 244, 246, and 248 to achieve desired properties of the respective flow of liquid working fluid directed therethrough, the expansion devices 220, 242, 244, 246, and 248 may also be controlled based on a detected level of liquid working fluid within the second section 162 of the chamber 126 from which the expansion devices 220, 242, 244, 246, and 248 receive the flow of liquid working fluid. For example, each second section 162 may include a corresponding sensor 256. The sensors 256 may be liquid level sensors, pressure sensors, temperature sensors, another suitable type of sensor, or any combination thereof configured to detect an operating parameter indicative of the liquid working fluid. The economizer system 102 may include a controller 258 (e.g., including a memory storing executable instructions and processing circuitry configured to execute the instructions) configured to receive feedback from the sensors 256, and the controller 258 may control operation of the actuator 254 (e.g., control positions of the expansion devices 220, 242, 244, 246, and 248) based on the feedback. For example, the controller 258 may adjust the positions of the expansion devices 220, 242, 244, 246, and 248 to cause an increase or decrease in the level of liquid working fluid within the section sections 162 of the chambers 126. It should be appreciated that the controller 258 may be similar to the control systems and controllers described above. In some embodiments, the controller 258 may be integrated with the control panel 40 discussed above or may be a separate controller.

Figure 10:
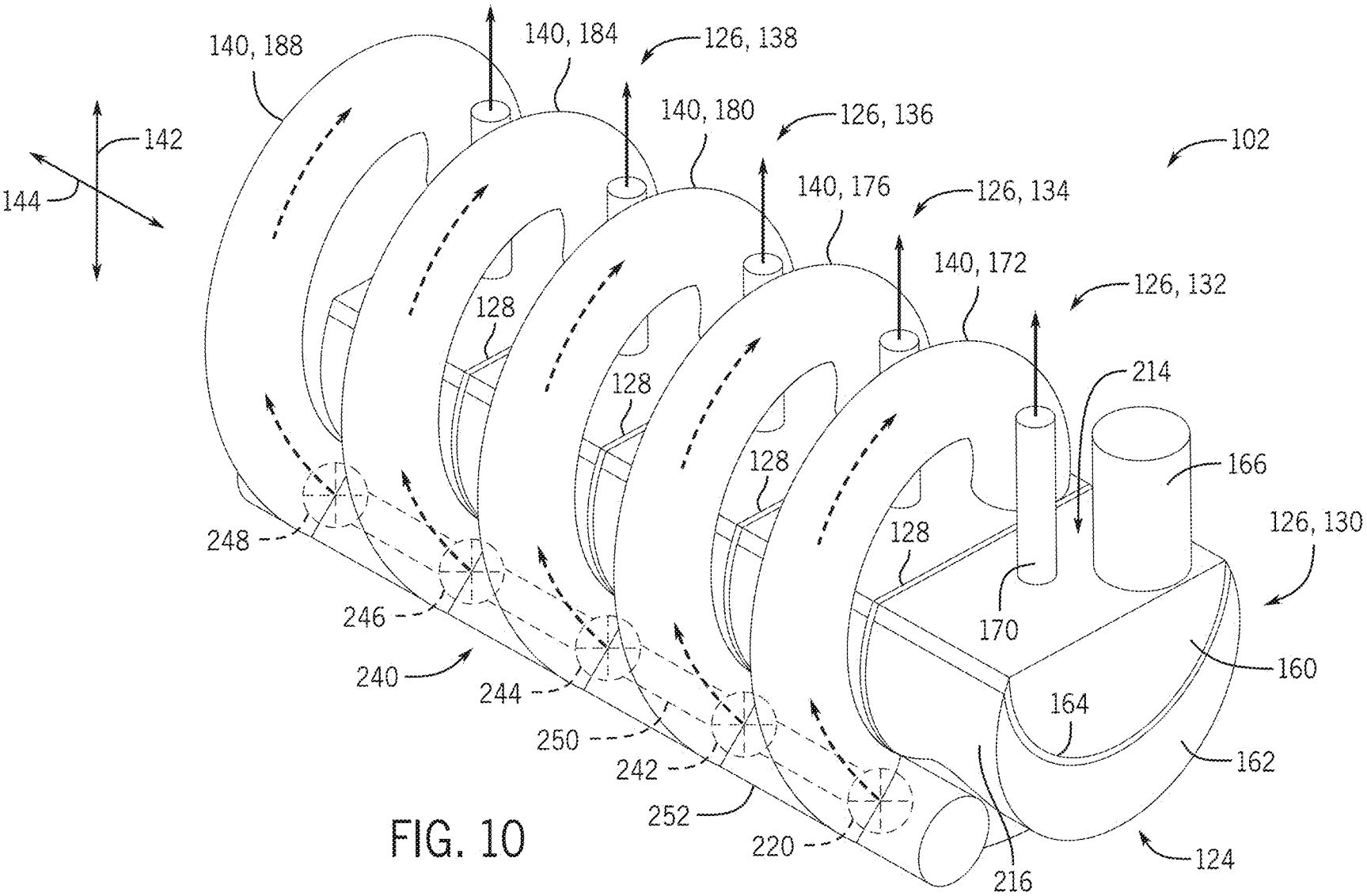
FIG. 10 is a perspective view schematic of an embodiment of an economizer having multiple chambers, in accordance with an aspect of the present disclosure.

FIG. 10 is a perspective view schematic of an embodiment of the economizer system 102, illustrating the economizer system 102 in a generally horizontal configuration (e.g., installed configuration). That is, the housing 124 of the economizer system 102 (e.g., a longitudinal axis of the housing 124) extends generally along the horizontal axis 144. Thus, the chambers 126 defined by the housing 124 are positioned in a side-by-side arrangement instead of a vertically stacked arrangement. The illustrated embodiment includes similar elements and element numbers as embodiments of the economizer system 102 described above. Indeed, the economizer system 102 of FIG. 10 and the components thereof may operate in a manner similar to the embodiments of the economizer system 102 described above.

With the economizer system 102 in the generally horizontal, installed orientation, the separation plates 128 extending between adjacent chambers 126 within the housing 124 may be generally vertical separation plates that extend along the vertical axis 142. However, in other embodiments, the separation plates 128 may be disposed at an angle (e.g., an acute angle) relative to the vertical axis 142. Additionally, in the illustrated configuration, the second section 162 of each chamber 126 may be disposed vertically below the first section 160 of the chamber 126 (e.g., relative to the vertical axis 142). Thus, the centrifugal acceleration forces imparted by the swirling motion or flow of the working fluid within the first section 160 may promote separation of liquid working fluid from vapor working fluid within the corresponding chamber 126, and force of gravity may also promote separation of liquid working fluid from vapor working fluid. That is, the force of gravity may at least partially cause liquid working fluid within the first section 160 to flow across or through the perforated sheet 164 within the chamber 126 (e.g., via the openings 210) and into the second section 162 below the first section 160.

Figure 11:
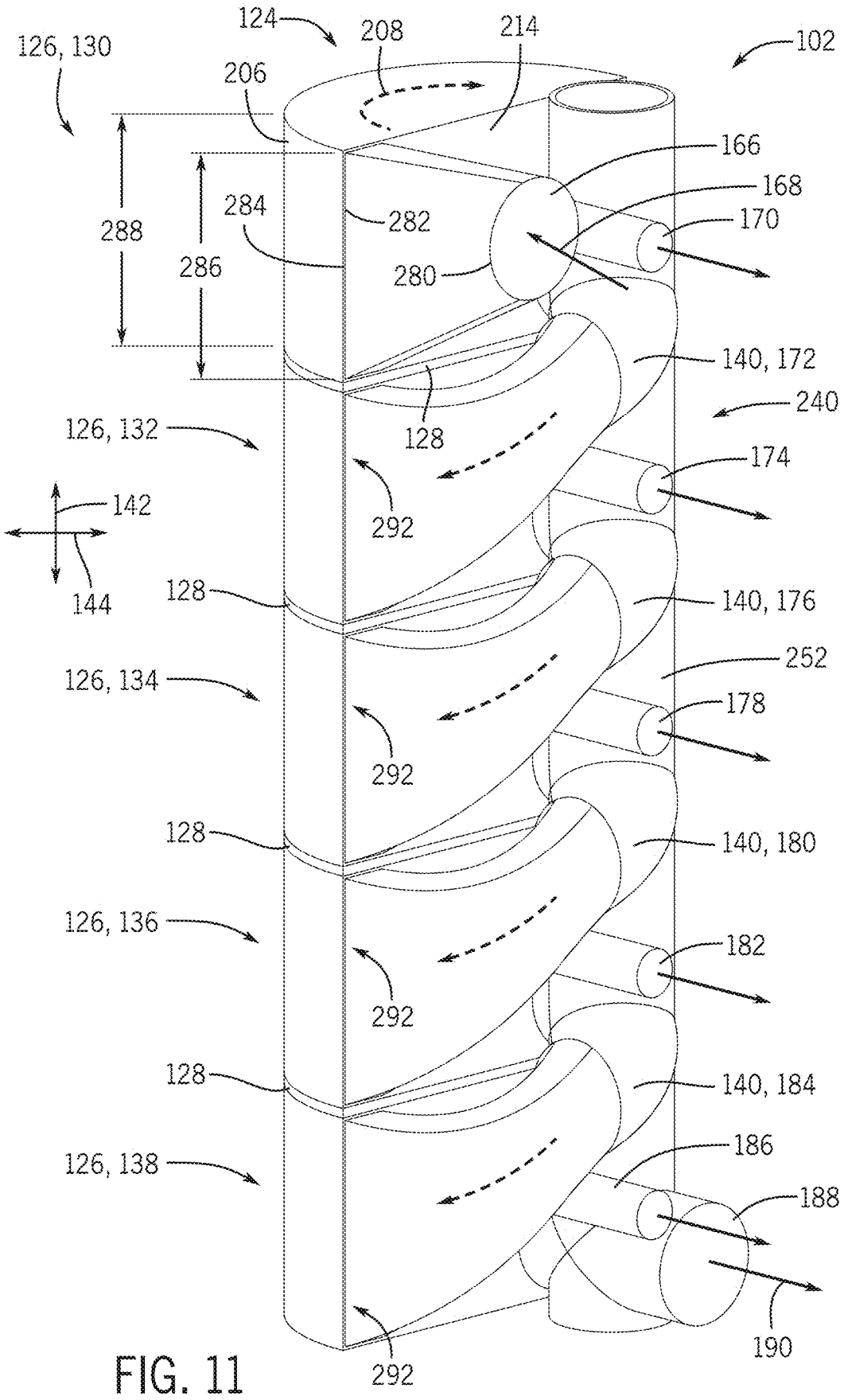
FIG. 11 is a perspective view schematic of an embodiment of an economizer having multiple chambers, in accordance with an aspect of the present disclosure.
Figure 12:
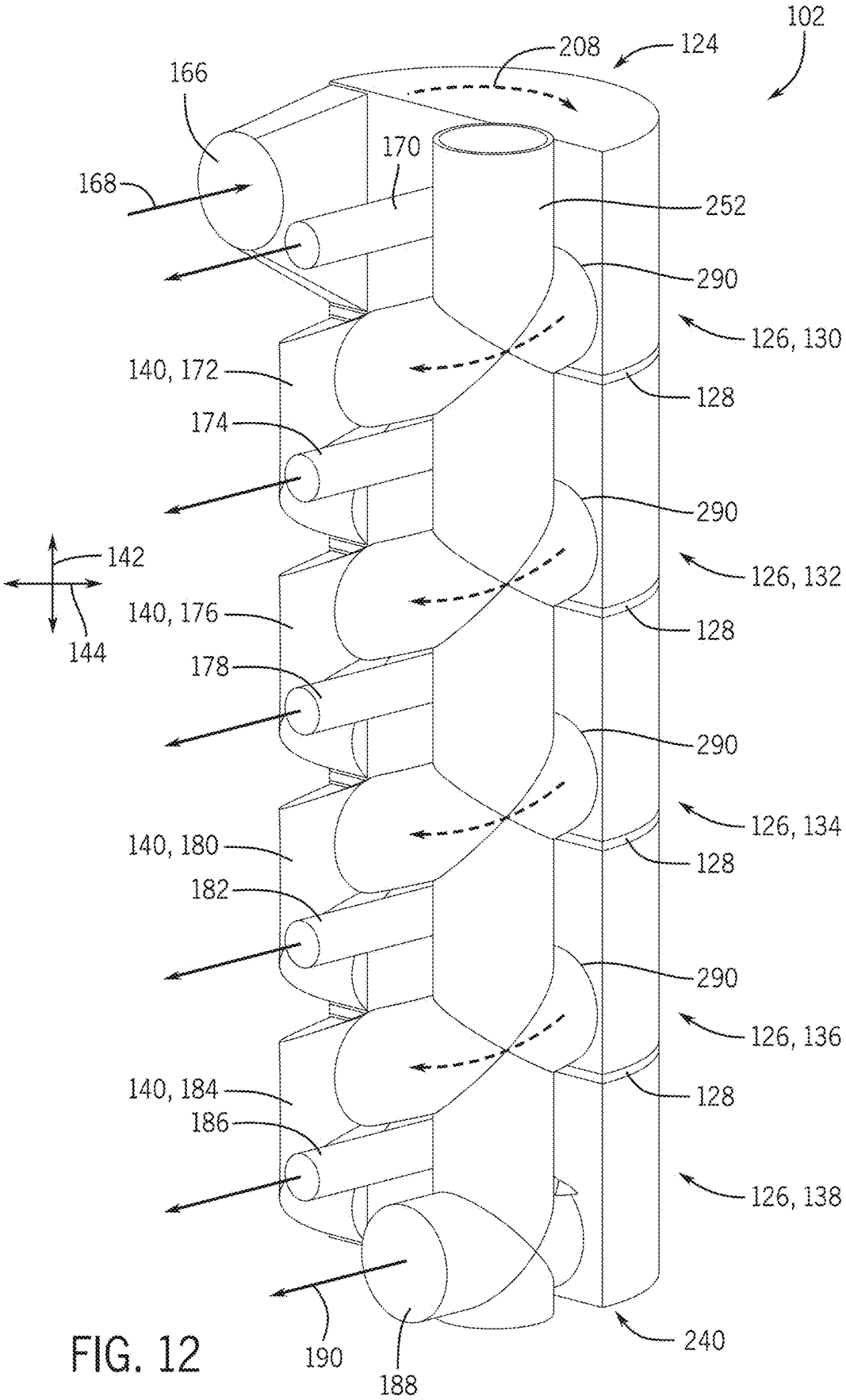
FIG. 12 is a perspective view schematic of an embodiment of an economizer having multiple chambers, in accordance with an aspect of the present disclosure.
Figure 13:
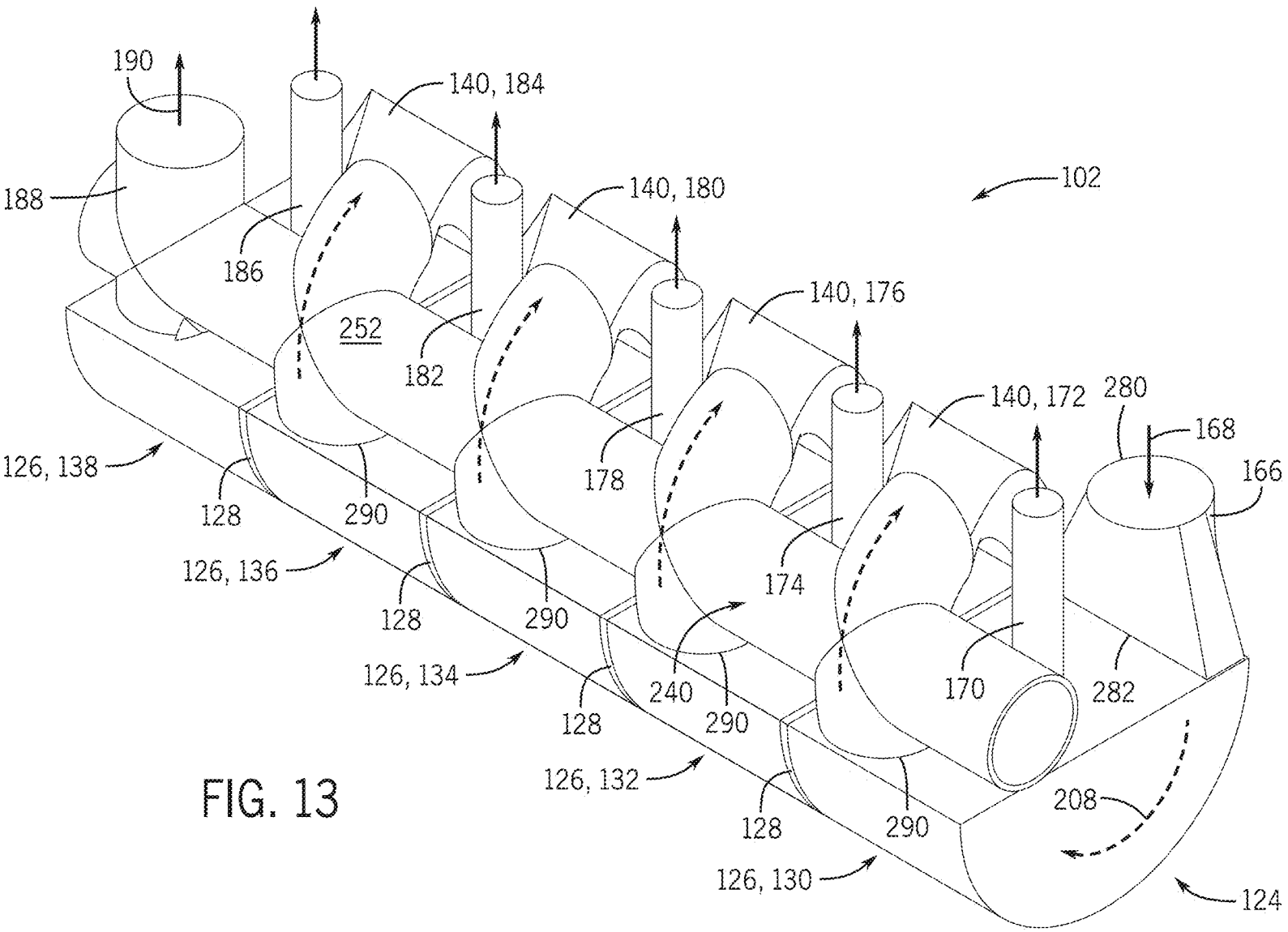
FIG. 13 is a perspective view schematic of an embodiment of an economizer having multiple chambers, in accordance with an aspect of the present disclosure.

FIGS. 11, 12, and 13 are perspective view schematics of additional embodiments of the economizer system 102. Specifically, FIGS. 11 and 12 illustrates the economizer system 102 in a vertical orientation (e.g., installed orientation), whereby the chambers 126 of the economizer system 102 are arrayed along the vertical axis 142 (e.g., stacked on top of one another), as described above. FIG. 13 illustrates the economizer system 102 in a horizontal orientation (e.g., installed orientation), whereby the chambers 126 of the economizer system 102 are arrayed side by side along the horizontal axis 144, as described above. The embodiments of FIGS. 11, 12 and 13 include similar elements and element numbers as the embodiments of the economizer system 102 discussed above. Indeed, the illustrated embodiments of the economizer system 102 and the components thereof may operate in a similar manner as that described above. For example, each chamber 126 of the illustrated economizer systems 102 may define the first section 160 and the second section 162 separated by the perforated sheet 164. The economizer systems 102 may operate to induce a swirling or circular flow of working fluid within each chamber 126 to enable separation liquid working fluid from vapor working fluid in the manner described above. The embodiments of FIGS. 11, 12 and 13 are discussed concurrently below.

The illustrated embodiments also include additional features that may enable improved performance of the economizer system 102. For example, the inlet conduit 166 and/or one or more of the conduits 140 (e.g., outlet conduits) extending from one chamber 126 to another chamber 126 may have a variable geometry (e.g., variable cross-sectional geometry) that enables improved separation of liquid working fluid from vapor working fluid within each chamber 126. Referring now to FIG. 11, the inlet conduit 166 includes an inlet portion 280 (e.g., upstream portion, relative to flow of working fluid through the inlet conduit 166) having a first cross-sectional geometry (e.g., a circular cross-sectional geometry) and an outlet portion 282 (e.g., downstream portion) having a second cross-sectional geometry (e.g., rectangular cross-sectional geometry, quadrilateral cross-sectional geometry, elliptical cross-sectional geometry). The inlet conduit 166 (e.g., a body of the inlet conduit 166) may gradually transition from the first cross-sectional geometry of the inlet portion 280 to the second cross-sectional geometry of the outlet portion 282.

As shown, the outlet portion 282 is coupled to the housing 124 (e.g., the first panel 214) of the economizer system 102 to fluidly couple the inlet conduit 166 to the first chamber 130, as similarly described above. The second cross-sectional geometry of the outlet portion 282 may enable improved inducement of the swirling or circular flow of the working fluid within the first chamber 130. For example, an edge identi or boundary of the second cross-sectional geometry (e.g., rectangular cross-sectional geometry) is generally aligned with the outer diameter 206 of the first chamber 130 (e.g., the second panel 216). Additionally, a dimension 286 of the edge 284 (e.g., along the vertical axis 142 in the installed orientation of the economizer system 102) may be equal or similar to (e.g., slightly less) a dimension 288 (e.g., a height) of the first chamber 130. Thus, the flow of working fluid may be introduced by the inlet conduit 166 into the first chamber 130 substantially along an entirety of the dimension 288 (e.g., height) of the first chamber 130. In this way, a greater amount of the working fluid may impinge (e.g., tangentially impinge) against the perforated sheet 164, which may improve inducement of the swirling or circular flow of the working fluid within the first chamber 130. Indeed, enhanced swirling flow of the working fluid within the first chamber 130 may enhance application of centrifugal acceleration forces to the working fluid, which may further improve separation of liquid working from vapor working fluid within the first chamber 130. It should be appreciated that the embodiments of FIGS. 12 and 13 may have similar features and enable similar functionality, but it should be noted that the embodiment of FIG. 13 illustrates the economizer system 102 in the horizontal orientation. Thus, the dimension 286 of the edge 284 may extend along the horizontal axis 144 and may be equal or similar to the dimension 288 (e.g., width) of the first chamber 130.

One or more conduits 140 of the economizer system 102 may include similar geometries, configurations, and/or features as the inlet conduit 166. As discussed above, one or more of the conduits 140 (e.g., liquid outlet conduits) may extend from one chamber 126 to another chamber 126 defined within the housing 124 to enable flow of working fluid (e.g., liquid working fluid) from one chamber 126 to another chamber 126. As similarly discussed above, one or more of the conduits 140 may also include variable geometry (e.g., cross-sectional geometry). For example, as shown in FIGS. 11 and 12, the first liquid outlet conduit 172 extending from the first chamber 130 to the second chamber 132 includes an inlet portion 290 (e.g., inlet port) coupled to the first chamber 130 (e.g., the second section 162 of the first chamber 130) and an outlet portion 292 (e.g., outlet port) coupled to the second chamber 132 (e.g., the first section 160 of the second chamber 132). The second liquid outlet conduit 176, the third liquid outlet conduit 180, and the fourth liquid outlet conduit 184 may similarly include respective inlet portions 290 (e.g., inlet ports) and outlet portions 292 (e.g., outlet ports) coupled to corresponding chambers 126.

As shown, the inlet portion 290 may include a first cross-sectional geometry (e.g., a circular cross-sectional geometry), and the outlet portion 292 may include a second cross-sectional geometry (e.g., a rectangular cross-sectional geometry, a quadrilateral cross-sectional geometry, an elliptical cross-sectional geometry, etc.). Indeed, a body of the first liquid outlet conduit 172 or other conduit 140 may transition (e.g., gradually transition, at a transition point along the conduit 140) from the first cross-sectional geometry at the inlet portion 290 to the second cross-sectional geometry at the outlet portion 292. For example, the first liquid outlet conduit 172 or other conduit 140 having the described variable cross-sectional geometry may be formed via a swage nozzle process, via a rolled sheet, or via another suitable technique and/or material. The outlet portion 292 of the conduit 140 (e.g., first liquid outlet conduit 172) may be configured in a manner similar to the outlet portion 282 of the inlet conduit 166. That is, the outlet portion 292 of the conduit 140 may define a dimension (e.g., a height along the vertical axis 142 in FIGS. 11 and 12, a width along the horizontal axis 144 in FIG. 13) that is the same or substantially similar to a corresponding dimension of the chamber 126 to which the outlet portion 292 is fluidly coupled. Thus, the conduit 140 may enable improved inducement of swirling or circular flow of working fluid within the chamber 126 to which the conduit 140 directs the flow of working fluid. In this way, improved separation of liquid working fluid from vapor working fluid may be enabled via improved inducement of centrifugal acceleration forces in the working fluid.

In accordance with present techniques, an economizer system includes multiple chambers or economizing stages configured to enable and/or induce a swirling or rotational flow of a working fluid to cause separation of the working fluid into liquid working fluid and vapor working fluid. The swirling flow of the working fluid may cause centrifugal acceleration forces to act on the working fluid, thereby promoting separation of the working fluid into the vapor working fluid and the liquid working fluid. Additionally, the swirling flow of working fluid enabled by the disclosed embodiments may enable more a compact configuration (e.g., reduced physical footprint) of the economizer, as compared to existing economizers. In this way, costs associated with manufacture and operation of HVAC&R systems may be reduced. Furthermore, in accordance with present techniques, the economizer system including multiple chambers configured to induce a swirling or rotational flow of the working fluid to separate the working fluid into the liquid working fluid and the vapor working fluid may enable improved operation of HVAC&R systems (e.g., improved efficiency) across a wide range of operating capacities.

While only certain features and embodiments of the present disclosure have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be noted that the appended claims are intended to cover all such modifications and changes as fall within the true spirit of the present disclosure.

Furthermore, in an effort to provide a concise description of the exemplary embodiments, all features of an actual implementation may not have been described (i.e., those unrelated to the presently contemplated best mode of carrying out the present disclosure, or those unrelated to enabling the claimed embodiments). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An economizer for a heating, ventilation, air conditioning, and refrigeration (HVAC&R) system, comprising:

a housing defining a first chamber and a second chamber;

an inlet conduit coupled to the housing and configured to direct a flow of working fluid into the first chamber; and a perforated sheet disposed within the first chamber, wherein the perforated sheet is curved and divides the first chamber into a first section and a second section, and the perforated sheet is configured to direct the flow of working fluid received by the first chamber in a circular direction to separate the flow of working fluid into liquid working fluid and vapor working fluid.

2. The economizer of claim 1, wherein the inlet conduit is configured to direct the flow of working fluid into the first section.

3. The economizer of claim 1, comprising a liquid outlet conduit extending between and fluidly coupling the second section of the first chamber and the second chamber, wherein the liquid outlet conduit is configured to direct the liquid working fluid in the circular direction.

4. The economizer of claim 3, wherein the liquid outlet conduit extends external to the housing.

5. The economizer of claim 3, wherein the liquid outlet conduit is curved and extends at least partially about the housing.

6. The economizer of claim 3, wherein the perforated sheet comprises openings configured to direct the liquid working fluid from the flow of working fluid into the second section, and the liquid outlet conduit is configured to direct the liquid working fluid from the second section to the second chamber.

7. The economizer of claim 3, comprising an expansion device disposed along the liquid outlet conduit, wherein the expansion device is configured to adjust a flow of the liquid working fluid directed toward the second chamber.

8. The economizer of claim 1, comprising a separation plate disposed within the housing and extending between the first chamber and the second chamber to separate the first chamber from the second chamber within the housing.

9. The economizer of claim 1, wherein the perforated sheet is a first perforated sheet, and the economizer comprises:

a second perforated sheet extending within the second chamber, wherein the second perforated sheet divides the second chamber into an additional first section and an additional second section; and a liquid outlet conduit extending from the second section of the first chamber to the additional first section of the second chamber, wherein the liquid outlet conduit extends external to the housing and is configured to direct the liquid working fluid from the second section of the first chamber to the additional first section of the second chamber in the circular direction.

10. The economizer of claim 1, wherein the first chamber and the second chamber are arrayed vertically relative to one another in an installed configuration of the economizer.

11. An economizer for a heating, ventilation, air conditioning, and refrigeration (HVAC&R) system, comprising:

a housing defining a first chamber and a second chamber;

an inlet conduit coupled to the housing and configured to direct a flow of working fluid into the first chamber;

a perforated sheet disposed within the first chamber, wherein the perforated sheet is curved and divides the first chamber into a first section and a second section, the perforated sheet is configured to direct the flow of working fluid received by the first chamber in a circular direction, and the perforated sheet is configured to separate the flow of working fluid into vapor working fluid and liquid working fluid; and a liquid outlet conduit extending from the first chamber to the second chamber, wherein the liquid outlet conduit is configured to direct the liquid working fluid from the first chamber toward the second chamber.

12. The economizer of claim 11, wherein the liquid outlet conduit extends externally to the housing, the liquid outlet conduit is curved, and the liquid outlet conduit is configured to direct the liquid working fluid in the circular direction.

13. The economizer of claim 12, comprising an expansion device disposed along the liquid outlet conduit, wherein the expansion device is configured to reduce a pressure of the liquid working fluid directed toward the second chamber.

14. The economizer of claim 11, wherein the inlet conduit is configured to direct the flow of working fluid into the first section of the first chamber, and the liquid outlet conduit extends from the second section of the first chamber.

15. The economizer of claim 14, comprising a vapor outlet conduit fluidly coupled to the first section of the first chamber, wherein the vapor outlet conduit is configured to discharge the vapor working fluid from the first chamber and direct the vapor working fluid toward a compressor of the HVAC&R system.

16. The economizer of claim 11, wherein the first chamber and the second chamber are vertically stacked on top of one another in an installed configuration of the economizer.

17. An economizer for a heating, ventilation, air conditioning, and refrigeration (HVAC&R) system, comprising:

a housing defining a first chamber and a second chamber, wherein the first chamber is configured to receive a flow of working fluid from a vapor compression circuit;

a separation plate disposed within the housing to separate the first chamber from the second chamber within the housing;

a perforated sheet disposed within the housing, wherein the perforated sheet extends within the first chamber, the perforated sheet divides the first chamber into a first section and a second section, the perforated sheet is configured to direct the flow of working fluid received by the first chamber in a circular direction, and the perforated sheet is configured to separate the flow of working fluid into vapor working fluid and liquid working fluid; and a liquid outlet conduit extending from the first chamber to the second chamber, wherein the liquid outlet conduit is configured to direct the liquid working fluid from the first chamber toward the second chamber in the circular direction.

18. The economizer of claim 17, wherein the first chamber is disposed vertically above the second chamber in an installed configuration of the economizer with the HVAC&R system, and the separation plate extends in a generally horizontal direction in the installed configuration of the economizer with the HVAC&R system.

19. The economizer of claim 17, wherein the liquid outlet conduit extends external to the housing and the liquid outlet conduit is curved and extends at least partially about the housing.

20. The economizer of claim 17, wherein each of the first chamber and the second chamber comprises one or more curved surfaces configured to guide the flow of working fluid in the circular direction.

* * * * *